US007726420B2

(12) United States Patent
Shen et al.

(10) Patent No.: US 7,726,420 B2
(45) Date of Patent: Jun. 1, 2010

(54) CUTTER HAVING SHAPED WORKING SURFACE WITH VARYING EDGE CHAMFER

(75) Inventors: Yuelin Shen, Houston, TX (US); Youhe Zhang, Tomball, TX (US); Steffen S. Kristiansen, Stavanger (NO)

(73) Assignee: Smith International, Inc., Houston, TX (US)

( * ) Notice: Subject to any disclaimer, the term of this patent is extended or adjusted under 35 U.S.C. 154(b) by 786 days.

(21) Appl. No.: 11/117,648

(22) Filed: Apr. 28, 2005

(65) Prior Publication Data

US 2005/0247492 A1 Nov. 10, 2005

Related U.S. Application Data

(60) Provisional application No. 60/566,751, filed on Apr. 30, 2004, provisional application No. 60/584,307, filed on Jun. 30, 2004, provisional application No. 60/648,863, filed on Feb. 1, 2005.

(51) Int. Cl.
*E21B 10/55* (2006.01)

(52) U.S. Cl. ..... 175/430; 175/434

(58) Field of Classification Search ..... 175/401, 175/426, 434, 430; 408/223, 713
See application file for complete search history.

(56) References Cited

U.S. PATENT DOCUMENTS

| | | | | |
|---|---|---|---|---|
| 3,141,746 | A | 7/1964 | Lai | |
| 3,745,623 | A | 7/1973 | Wentorf et al. | |
| 4,373,593 | A | 2/1983 | Phaal et al. | |
| 4,534,773 | A | 8/1985 | Phaal et al. | |
| 4,570,726 | A | 2/1986 | Hall | |
| 4,681,488 | A * | 7/1987 | Markusson | 407/114 |
| 4,792,001 | A | 12/1988 | Zijsling | |
| 4,976,324 | A | 12/1990 | Tibbitts | |
| 4,984,642 | A | 1/1991 | Renard et al. | |
| 5,120,327 | A | 6/1992 | Dennis | |
| 5,127,923 | A | 7/1992 | Bunting et al. | |
| 5,135,061 | A | 8/1992 | Newton, Jr. | |

(Continued)

FOREIGN PATENT DOCUMENTS

EP 0 336 698 A2 10/1989

(Continued)

OTHER PUBLICATIONS

Combined Search and Examination Report issued in corresponding British Application No. GB0609713.3; Dated Jul. 6, 2006; 5 pages.

(Continued)

*Primary Examiner*—Shane Bomar
(74) *Attorney, Agent, or Firm*—Christie, Parker & Hale, LLP

(57) ABSTRACT

A cutter for a drill bit used for drilling wells in a geological formation includes an ultra hard working surface and a chamfer along an edge of the working surface, wherein the chamfer has a varied geometry along the edge. The average geometry of the chamfer varies with cutting depth. A depression in the shaped working surface is oriented with the varied chamfer and facilitates forming the varied chamfer. A non-planar interface has depressions oriented with depressions in the shaped working surface to provide support to loads on the working surface of the cutter when used.

45 Claims, 17 Drawing Sheets

U.S. PATENT DOCUMENTS

| | | | | |
|---|---|---|---|---|
| 5,217,081 | A | 6/1993 | Waldenström et al. | |
| 5,238,074 | A | 8/1993 | Tibbitts et al. | |
| 5,332,051 | A | 7/1994 | Knowlton | |
| 5,348,108 | A | 9/1994 | Scott et al. | |
| 5,351,772 | A | 10/1994 | Smith | |
| 5,437,343 | A | 8/1995 | Cooley et al. | |
| 5,486,137 | A | 1/1996 | Flood et al. | |
| 5,662,183 | A | 9/1997 | Fang | |
| 5,722,499 | A | 3/1998 | Nguyen et al. | |
| 5,813,485 | A | 9/1998 | Portwood | |
| 5,871,060 | A | 2/1999 | Jensen et al. | |
| 5,881,830 | A | 3/1999 | Cooley | |
| 5,928,071 | A | 7/1999 | Devlin | |
| 5,954,147 | A | 9/1999 | Overstreet et al. | |
| 5,957,228 | A | 9/1999 | Yorston et al. | |
| 5,979,578 | A | 11/1999 | Packer | |
| 6,000,483 | A | 12/1999 | Jurewicz et al. | |
| 6,009,963 | A | 1/2000 | Chaves et al. | |
| 6,011,232 | A | 1/2000 | Matthias | |
| 6,039,515 | A * | 3/2000 | Lamberg | 408/188 |
| 6,045,440 | A | 4/2000 | Johnson et al. | |
| 6,050,354 | A | 4/2000 | Pessier et al. | |
| 6,053,263 | A | 4/2000 | Meiners | |
| 6,059,054 | A | 5/2000 | Portwood et al. | |
| 6,082,223 | A * | 7/2000 | Tibbitts | 76/108.2 |
| 6,082,474 | A | 7/2000 | Matthias | |
| 6,135,206 | A * | 10/2000 | Gano et al. | 166/297 |
| 6,135,219 | A | 10/2000 | Scott | |
| 6,196,340 | B1 | 3/2001 | Jensen et al. | |
| 6,199,645 | B1 | 3/2001 | Anderson et al. | |
| 6,202,770 | B1 | 3/2001 | Jurewicz et al. | |
| 6,202,771 | B1 | 3/2001 | Scott et al. | |
| 6,213,692 | B1 * | 4/2001 | Guehring et al. | 408/144 |
| 6,227,318 | B1 | 5/2001 | Siracki | |
| 6,244,365 | B1 | 6/2001 | Southland | |
| 6,287,352 | B1 * | 9/2001 | Littecke et al. | 51/309 |
| 6,290,008 | B1 * | 9/2001 | Portwood et al. | 175/426 |
| 6,315,067 | B1 | 11/2001 | Fielder | |
| 6,315,652 | B1 | 11/2001 | Snyder et al. | |
| 6,330,924 | B1 | 12/2001 | Hall | |
| 6,443,248 | B2 | 9/2002 | Yong et al. | |
| 6,510,910 | B2 | 1/2003 | Eyre et al. | |
| 6,527,069 | B1 | 3/2003 | Meiners et al. | |
| 6,550,556 | B2 | 4/2003 | Middlemiss et al. | |
| 6,604,588 | B2 * | 8/2003 | Eyre et al. | 175/374 |
| 6,669,412 | B1 * | 12/2003 | Hirose et al. | 407/113 |
| 6,685,402 | B2 * | 2/2004 | Mast et al. | 408/227 |
| 6,715,967 | B2 * | 4/2004 | Wiman et al. | 407/114 |
| 6,761,510 | B2 * | 7/2004 | Kinukawa et al. | 407/113 |
| 6,929,079 | B2 | 8/2005 | McDonough et al. | |
| 7,225,886 | B1 * | 6/2007 | Hall | 175/57 |
| 7,533,740 | B2 | 5/2009 | Zhang et al. | |
| 2001/0040053 | A1 * | 11/2001 | Beuershausen | 175/57 |
| 2003/0062201 | A1 * | 4/2003 | Eyre et al. | 175/426 |
| 2003/0170079 | A1 * | 9/2003 | Daiguji et al. | 407/34 |
| 2005/0019119 | A1 * | 1/2005 | Jager | 408/191 |
| 2005/0247492 | A1 | 11/2005 | Shen et al. | |
| 2005/0263327 | A1 | 12/2005 | Meiners et al. | |
| 2006/0060390 | A1 | 3/2006 | Eyre et al. | |
| 2006/0060392 | A1 | 3/2006 | Eyre | |
| 2006/0228179 | A1 * | 10/2006 | Alm et al. | 407/113 |
| 2006/0283639 | A1 | 12/2006 | Yong et al. | |
| 2007/0079994 | A1 | 4/2007 | Middlemiss | |

FOREIGN PATENT DOCUMENTS

| | | | |
|---|---|---|---|
| EP | 1 116 858 | A1 | 7/2001 |
| EP | 1 190 791 | A2 | 3/2002 |
| GB | 2 204 625 | A | 11/1988 |
| GB | 2 300 437 | A | 11/1996 |
| GB | 2 307 933 | A | 6/1997 |
| GB | 2 323 398 | A | 9/1998 |
| GB | 2 367 081 | A | 3/2002 |
| GB | 2 403 967 | A | 1/2005 |
| GB | 2 413 575 | A | 11/2005 |
| GB | 2 418 215 | A | 3/2006 |
| GB | 2 429 727 | A | 3/2007 |
| SU | 791889 | | 12/1980 |
| WO | WO-97/48873 | | 12/1997 |
| WO | WO 2004/040095 | A1 | 5/2004 |

OTHER PUBLICATIONS

Official Action issued in corresponding Canadian Appl. No. 2,505,709; Dated Apr. 28, 2006; 4 pages.

Examination Report Under Section 18(3) issued on corresponding British Application No. GB0508875.2; Dated Mar. 16, 2006; 2 pages.

* cited by examiner

CUTTER HAVING SHAPED WORKING SURFACE WITH VARYING EDGE CHAMFER

This application claims priority, pursuant to 35 U.S.C. §119(e), to U.S. Provisional Patent Application No. 60/566,751 filed Apr. 30, 2004, U.S. Provisional Patent Application No. 60/584,307 filed Jun. 30, 2004, and U.S. Provisional Patent Application No. 60/648,863, filed Feb. 1, 2005. Those applications are incorporated by reference in their entireties.

BACKGROUND OF INVENTION

1. Field of the Invention

The invention relates generally to drill bits in the oil and gas industry, particularly to drill bits having cutters or inserts having hard and ultra hard cutting surfaces or tables and to cutters or inserts for drill bit such as drag bits and more particularly to cutters and inserts with ultra hard working surfaces made from materials such as diamond material, polycrystalline diamond material, or other ultra hard material bonded to a substrate and/or to a support stud.

2. Background Art

Rotary drill bits with no moving elements on them are typically referred to as "drag" bits. Drag bits are often used to drill very hard or abrasive formations. Drag bits include those having cutters (sometimes referred to as cutter elements, cutting elements or inserts) attached to the bit body. For example the cutters may be formed having a substrate or support stud made of cemented carbide, for example tungsten carbide, and an ultra hard cutting surface layer or "table" made of a polycrystalline diamond material or a polycrystalline boron nitride material deposited onto or otherwise bonded to the substrate at an interface surface.

An example of a prior art drag bit having a plurality of cutters with ultra hard working surfaces is shown in FIG. 1. The drill bit 10 includes a bit body 12 and a plurality of blades 14 that are formed in the bit body 12. The blades 14 are separated by channels or gaps 16 that enable drilling fluid to flow between and both clean and cool the blades 14. Cutters 18 are held in the blades 14 at predetermined angular orientations to present working surfaces 20 with a desired rake angle against a formation to be drilled. Typically, the working surfaces 20 are generally perpendicular to the axis 19 and side surface 21 of a cylindrical cutter 18. Thus the working surface 20 and the side surface 21 form a circumferential cutting edge 22. Nozzles 23 are typically formed in the drill bit body 12 and positioned in the gaps 16 so that fluid can be pumped to discharge drilling fluid in selected directions and at selected rates of flow between the cutting blades 14 for lubricating and cooling the drill bit 10, the blades 14 and the cutters 18. The drilling fluid also cleans and removes the cuttings as the drill bit rotates and penetrates the formation. The gaps 16, which may be referred to as "fluid courses," are positioned to provide additional flow channels for drilling fluid and to provide a passage for formation cuttings to travel past the drill bit 10 toward the surface of a wellbore (not shown).

The drill bit 10 includes a shank 24 and a crown 26. Shank 24 is typically formed of steel or a matrix material and includes a threaded pin 28 for attachment to a drill string. Crown 26 has a cutting face 30 and outer side surface 32. The particular materials used to form drill bit bodies are selected to provide adequate toughness, while providing good resistance to abrasive and erosive wear. For example, in the case where an ultra hard cutter is to be used, the bit body 12 may be made from powdered tungsten carbide (WC) infiltrated with a binder alloy within a suitable mold form. In one manufacturing process the crown 26 includes a plurality of holes or sockets 34 that are sized and shaped to receive a corresponding plurality of cutters 18. The combined plurality of cutting edges 22 of the cutters 18 effectively forms the cutting face of the drill bit 10. Once the crown 26 is formed, the cutters 18 are mounted in the sockets 34 and affixed by any suitable method, such as brazing, adhesive, mechanical means such as interference fit, or the like. The design depicted provides the sockets 34 inclined with respect to the surface of the crown 26. The sockets are inclined such that cutters 18 are oriented with the working face 20 generally perpendicular to the axis 19 of the cutter 18 and at a desired rake angle in the direction of rotation of the bit 10, so as to enhance cutting. It will be understood that in an alternative construction, the sockets can each be substantially perpendicular to the surface of the crown, while an ultra hard surface 36 is affixed to a substrate 38 at an angle on the cutter body or stud 40 so that a desired rake angle is achieved at the working surface.

A typical cutter 18 is shown in FIG. 2. The typical cutter has a cylindrical cemented carbide substrate body 38 having an end face or upper surface 54 referred to herein as the "interface surface" 54. An ultra hard material layer 44, such as polycrystalline diamond or polycrystalline cubic boron nitride layer, forms the working surface 20 and the cutting edge 22. A bottom surface 52 of the cutting layer 44 is bonded on to the upper surface 54 of the substrate 38. The joining surfaces are herein referred to as the interface 46. The top exposed surface or working surface 20 of the cutting layer 44 is opposite the bonded surface 52. The cutting layer 44 typically has a flat or planar working surface 20, but may also have a curved exposed surface, that meets the side surface 21 at a cutting edge 22.

Cutters may be made, for example, according to the teachings of U.S. Pat. No. 3,745,623, whereby a relatively small volume of ultra hard particles such as diamond or cubic boron nitride is sintered as a thin layer onto a cemented tungsten carbide substrate. Flat top surface cutters as shown in FIG. 2 are generally the most common and convenient to manufacture with an ultra hard layer according to known techniques. It has been found that cutter chipping, spalling and delaminating is common for ultra hard flat top surface cutters.

Generally speaking, the process for making a cutter 18 employs a body of cemented tungsten carbide as the substrate 38 where the tungsten carbide particles are cemented together with cobalt. The carbide body is placed adjacent to a layer of ultra hard material particles such as diamond or cubic boron nitride particles and the combination is subjected to high temperature at a pressure where the ultra hard material particles are thermodynamically stable. This results in recrystallization and formation of a polycrystalline ultra hard material layer, such as a polycrystalline diamond or polycrystalline cubic boron nitride layer, directly onto the upper surface 54 of the cemented tungsten carbide substrate 38.

It has been found by applicants that many cutters develop cracking, spalling, chipping and partial fracturing of the ultra hard material cutting layer at a region of cutting layer subjected to the highest loading during drilling. This region is referred to herein as the "critical region" 56. The critical region 56 encompasses the portion of the cutting layer 44 that makes contact with the earth formations during drilling. The critical region 56 is subjected to the generation of peak (high magnitude) stresses form normal loading, shear force loading and impact loading imposed on the ultra hard material layer 44 during drilling. Because the cutters are typically inserted into a drag bit at a rake angle, the critical region includes a portion of the ultra hard material layer near and including a portion of the layer's circumferential edge 22 that makes contact with the earth formations during drilling. The peak stresses at the critical region alone or in combination with other factors, such as residual thermal stresses, can result in the initiation and growth of cracks 58 across the ultra hard layer 44 of the cutter 18. Cracks of sufficient length may cause the separation of a sufficiently large piece of ultra hard material, rendering the cutter 18 ineffective or resulting in the failure of the cutter 18. When this happens, drilling operations may have to be ceased to allow for recovery of the drag bit and replacement of the ineffective or failed cutter. The high stresses, particularly shear stresses, can also result in delamination of the ultra hard layer 44 at the interface 46.

One type of ultra hard working surface 20 for fixed cutter drill bits is formed as described above with polycrystalline diamond on the substrate of tungsten carbide, typically known as a polycrystalline diamond compact (PDC), PDC cutters, PDC cutting elements or PDC inserts. Drill bits made using such PDC cutters 18 are known generally as PDC bits. While the cutter or cutter insert 18 is typically formed using a cylindrical tungsten carbide "blank" or substrate 38 which is sufficiently long to act as a mounting stud 40, the substrate 38 may also be an intermediate layer bonded at another interface to another metallic mounting stud 40. The ultra hard working surface 20 is formed of the polycrystalline diamond material, in the form of a layer 44 (sometimes referred to as a "table") bonded to the substrate 38 at an interface 46. The top of the ultra hard layer 44 provides a working surface 20 and the bottom of the ultra hard layer 44 is affixed to the tungsten carbide substrate 38 at the interface 46. The substrate 38 or stud 40 is brazed or otherwise bonded in a selected position on the crown of the drill bit body 12. As discussed above with reference to FIG. 1, the PDC cutters 18 are typically held and brazed into sockets 34 formed in the drill bit body at predetermined positions for the purpose of receiving the cutters 18 and presenting them to the formation at a rake angle.

In order for the body of a drill bit to also be resistant to wear, hard and wear resistant materials such as tungsten carbide are typically used to form drill bit body for holding the PDC cutters. Such a drill bit body is very hard and difficult to machine. Therefore, the selected positions at which the PDC cutters 18 are to be affixed to the bit body 12 are typically formed substantially to their final shape during the bit body molding process. A common practice in molding the drill bit body is to include in the mold, at each of the to-be-formed PDC cutter mounting positions, a shaping element called a "displacement." A displacement is generally a small cylinder made from graphite or other heat resistant material which is affixed to the inside of the mold at each of the places where a PDC cutter is to be located on the finished drill bit. The displacement forms the shape of the cutter mounting positions during the bit body molding process. See, for example, U.S. Pat. No. 5,662,183 issued to Fang for a description of the infiltration molding process using displacements.

It has been found by applicants that cutters with sharp cutting edges or small back rake angles provide good drilling rate of penetration, but are often subject to instability and are susceptible to chipping, cracking or partial fracturing when subjected to high forces normal to the working surface. For example, large forces can be generated when the cutter "digs" or "gouges" deep into the formation or when sudden changes in formation hardness produce sudden impact loads. Small back rake angles also have less delamination resistance when subjected to shear load. Cutters with large back rake angles are often subjected to heavy wear, abrasion and shear forces resulting in chipping, spalling, and delaminating due to excessive WOB required to obtain reasonable ROP. Thick ultra hard layers that might be good for abrasion wear are often susceptible to cracking, spalling, and delaminating as a result of residual thermal stresses associated with formation of thick ultra hard layers. The susceptibility to such deterioration and failure mechanisms is accelerated when combined with excessive load stresses.

FIG. 3 shows a prior art PDC cutter held at an angle in a drill bit 10 for cutting into a formation. The cutter 18 includes a diamond material table 44 affixed to a tungsten carbide substrate 38 that is bonded into the socket 34 formed in a drill bit blade 14. The drill bit 10 (see FIG. 1) will be rotated for cutting the inside surface of a cylindrical well bore. Generally speaking, the back rake angle "A" is used to describe the working angle of the working surface 20, and it also corresponds generally to the attack angle "B" made between the working surface 20 and an imaginary tangent line at the point of contact with the well bore. It will be understood that the "point" of contact is actually an edge or region of contact that corresponds to critical region 56 of maximum stress on the cutter 18. Typically, the geometry of the cutter 18 relative to the well bore is described in terms of the back rake angle "A."

Different types of bits are generally selected based on the nature of the formation to be drilled. Drag bits are typically selected for relatively soft formations such as sands, clays and some soft rock formations that are not excessively hard or excessively abrasive. However selecting the best bit is not always practical because many formations have mixed characteristics (i.e., the formation may include both hard and soft zones), depending on the location and depth of the well bore. Changes in the formation can affect the desired type of bit, the desired rate of penetration (ROP) of a bit, the desired rotation speed, and the desired downward force or weight on the bit (WOB). Where a drill bit is operating outside the desired ranges of operation, the bit can be damaged or the life of the bit can be severely reduced. For example, a drill bit normally operated in one general type of formation may penetrate into a different formation too rapidly or too slowly subjecting it to too little load or too much load. For another example, a drill bit rotating and penetrating at a desired speed may encounter an unexpectedly hard material, possibly subjecting the bit to surprise impact force. A material that is softer than expected may result in a high rate of rotation, a high rate of penetration (ROP), or both, that can cause the cutters to shear too deeply or to gouge into the formation. This can place greater loading, excessive shear forces and added heat on the working surface of the cutters. Rotation speeds that are too high without sufficient WOB, for a particular drill bit design in a given formation, can also result in detrimental instability and chattering because the drill bit cuts too deeply, intermittently bites into the formation or leaves too much clearance following the bit. Cutter chipping, spalling, and delaminating, in these and other situations, are common for ultra hard flat top surface cutters.

Dome cutters have provided certain benefits against gouging and the resultant excessive impact loading and instability. This approach for reducing adverse effects of flat surface cutters is described in U.S. Pat. No. 5,332,051. An example of such a dome cutter in operation is depicted in FIG. 4. The prior art cutter 60 has a dome shaped top or working surface 62 that is formed with an ultra hard layer 64 bonded to a substrate 66. The substrate 66 is bonded to a metallic stud 68. The cutter 60 is held in a blade 70 of a drill bit 72 (shown in partial section) and engaged with a geological formation 74 (also shown in partial section) in a cutting operation. The dome shaped working surface 62 effectively modifies the rake angle A that would be produced by the orientation of the cutter 60. It has been found by applicants that chipping at the edge of the working surface continues to be associated with some dome cutters.

Scoop cutters, as shown in FIG. 5 (U.S. Pat. No. 6,550,556), have also provided some benefits against the adverse effects of impact loading. This type of prior art cutter 80 is made with a scoop top working surface 82 formed in an ultra hard layer 84 that is bonded to a substrate 86 at an interface 88. A depression 90 sometimes referred to as a "scoop" is formed in the critical region 56. The substrate upper surface 92 has a depression 94 corresponding to the depression 90, such that the depression 90 does not make the ultra hard layer 84 too thin. The interface 88 may be referred to as a non-planar interface (NPI). It has been found by applicants that while scoop cutters provide some benefits against the adverse effects of impact loading, additional improvement is desirable.

Diamond cutters provided with single or multiple chamfers with constant chamfer geometry (U.S. Pat. No. 5,437,343) have been proposed for reduction of chipping and cracking at the edge of the cutter. In these designs the size and the angle of each chamfer are constant circumferentially around the cutting edge. It has been found by applicants that constant chamfer geometry can provide some additional strength and support to the contact edge, yet the cutting efficiency can be reduced at all cutting depths and amount of support to the ultra hard layer and the strength of the edge is uniform with changing depth of cut. It has been found by applicants that increased strength due to a constant size and shape chamfer and does not necessarily counter act the extra proportional increase of loading associated with changes in cutting depth when using cylindrically shaped cutters. It has been found that without appropriately designed NPI, multiple stepped chamfer top surfaces can also result in extra thickness toward the center of the cutter. This can result in a corresponding increase in residual thermal stress and associated cracking, crack propagation, chipping and spalling.

Thus, cutters are desired that can better withstand high loading at the critical region imposed during drilling so as to have an enhanced operating life. Cutters that cut efficiently at designed speed and loading conditions and that regulate the amount of cutting load in changing formations are also desired. In addition, cutting elements that variably increase the strength of the cutter edges in response to increased cutting depth are further desired.

SUMMARY OF INVENTION

One aspect of the present invention relates to an ultra hard cutter having a shaped working surface that includes a varying geometry chamfer that is useful for drill bits used for drilling various types of geological formations. In certain embodiments, the ultra hard layer forms or is formed to provide a shaped working surface that has, at the cutting edge, a chamfer that varies in geometry with cutting depth. According to this aspect of the invention the varied geometry of the chamfer acts to reduce certain adverse consequences of sudden increased loading due to changes in the geological formation or in the manner of drill bit operation.

According to another aspect of the invention, a shaped working surface cutter also includes one or more depressions in the shaped working surface that facilitate formation of a desired varied geometry chamfer and that can also provide other useful cutter characteristics.

According to another aspect of the invention, a non-planer interface is formed between the ultra hard cutter layer and the substrate in a configuration oriented to the shaped working surface to provide increased thickness at the cutting edge of the shaped working surface in the critical region.

According to another aspect of the invention, a shaped working surface cutter has been discovered to provide reduced shear forces and also to provide additional strength against adverse effects of shear such as reduced susceptibility to spalling and delaminating.

According to another aspect of the invention, a cutter provides a useful combination taking into consideration the shape of the working surface, variations in chamfer geometry (including variations in cutting edge width, cutting edge angle or both) and/or the shape of the NPI to achieve improved toughness, reduced residual thermal stress, reduced cracking, reduced spalling, and reduced delamination.

According to another aspect of the invention a drill bit is formed using cutters with variable chamfers to obtain a desired "effective" back rake angle provided by the combined effect of the angle of the top working surface of the cutter and the angle and depth of the chamfers at the critical areas at which the cutters engage the formation during drilling.

According to another aspect of the invention the chamfer of a cutter is varied depending upon the position on a drill bit and the predicted shape and depth of cut of the cutter during drilling. Other aspects and advantages of the invention will be apparent from the following description and the appended claims.

DETAILED DESCRIPTION

Embodiments of the present invention relate to cutters having shaped working surfaces with a varied geometry chamfer. By using such a structure, the present inventors have discovered that such cutters can better withstand high loading at the critical region imposed during drilling so as to have an enhanced operating life. According to certain aspects of the invention, cutters with shaped working surfaces with variable chamfer can cut efficiently at designed speed, penetration and loading conditions and can compensate for the amount of cutting load in changing formations. Such varied chamfer geometry has been found to variably increase the strength of the cutter edges in response to increased cutting depth, and according to certain aspects of the invention, to increase the strength of the cutter edges proportionally to the increased load associated with increased depth of cutting.

Figure 1:
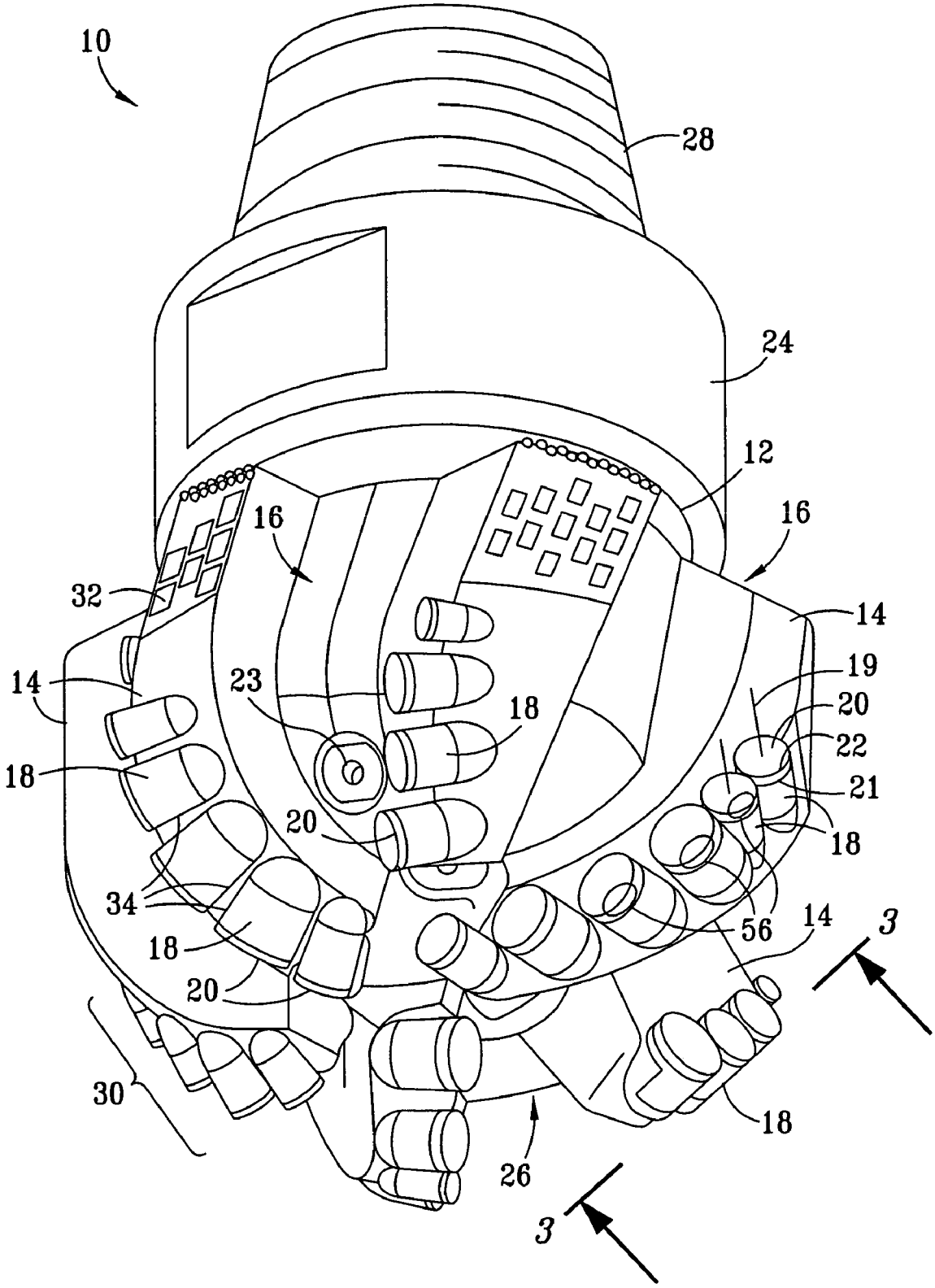
FIG. 1 (PRIOR ART)
FIG. 1 is a perspective view of a prior art fixed cutter drill bit sometimes referred to as a "drag bit"
Figure 2:
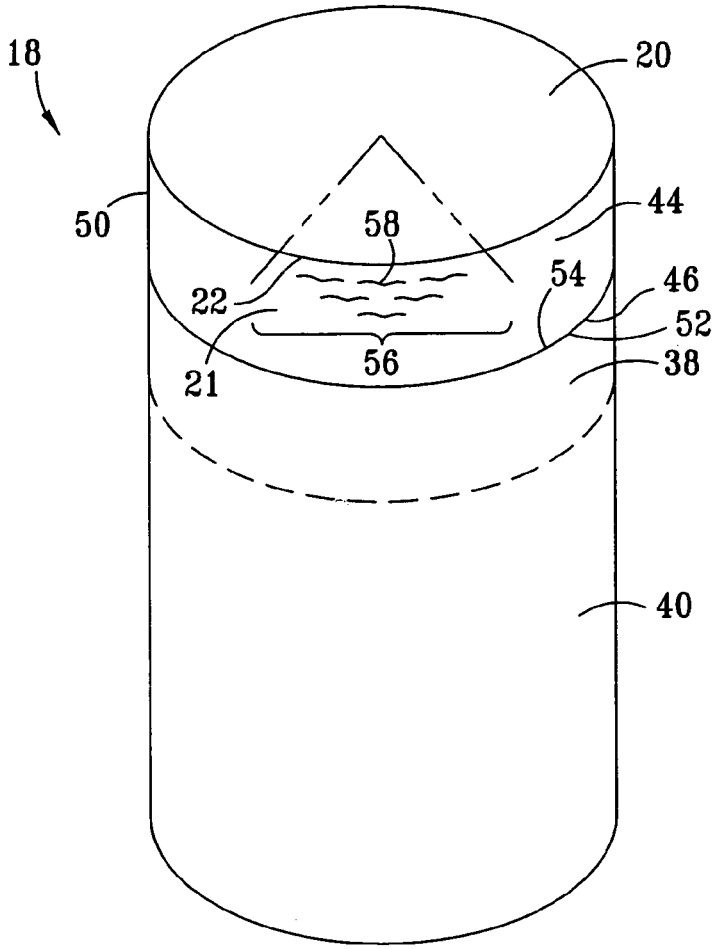
FIG. 2 (PRIOR ART)
FIG. 2 is a perspective view of a prior art cutter or cutter insert with an ultra hard layer bonded to a substrate or stud.
Figure 3:
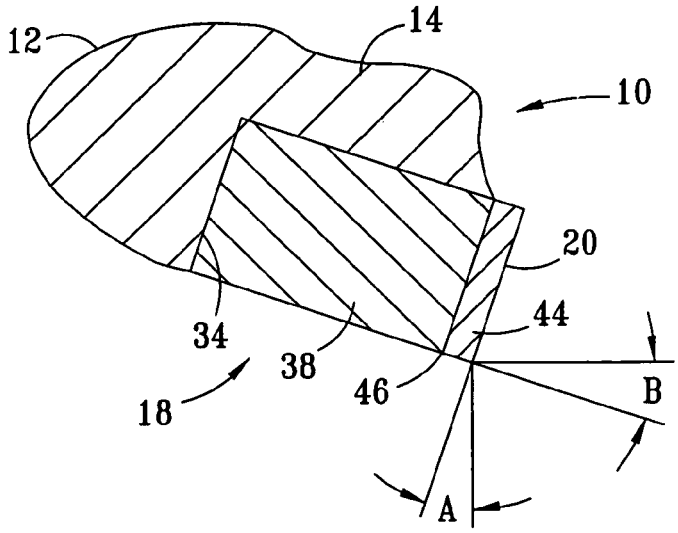
FIG. 3 (PRIOR ART)
FIG. 3 is a partial section view of a prior art flat top cutter held in a blade of a drill bit.
Figure 4:
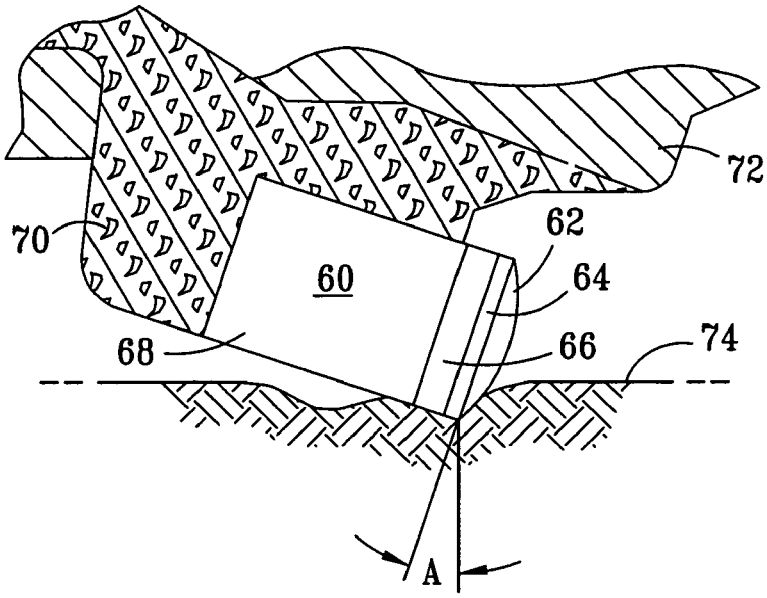
FIG. 4 (PRIOR ART)
FIG. 4 is schematic view of a prior art dome top cutter with an ultra hard layer bonded to a substrate that is bonded to a stud, where the cutter is held in a blade of a drill bit (shown in partial section) and engaged with a geological formation (also shown in partial section) in a cutting operation.
Figure 5:
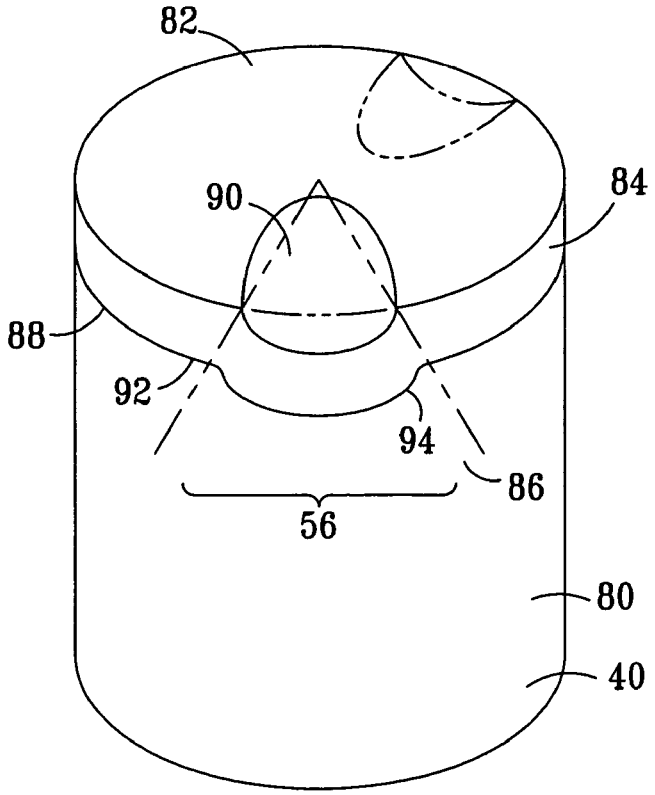
FIG. 5 (PRIOR ART)
FIG. 5 is a perspective view of a prior art scoop top cutter with an ultra hard layer bonded to a substrate at a non-planar interface (NPI)
Figure 6A:
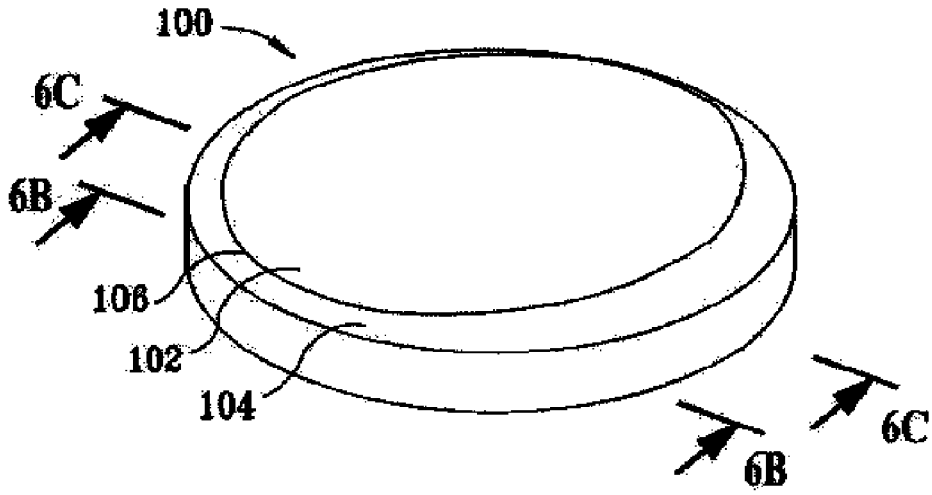
FIG. 6 is a perspective view of an ultra hard top layer having a varied geometry chamfer circumferentially around the cutting edge of the working surface of the ultra hard layer wherein the size of the chamfer is varied circumferentially around the cutting edge according to one embodiment of the present invention.
Figure 6B:
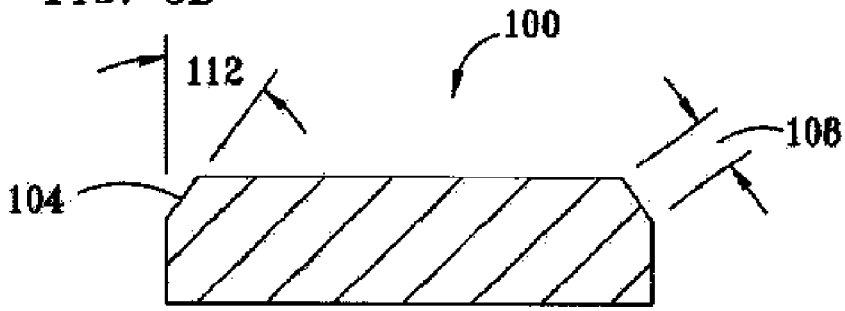
Figure 6C:
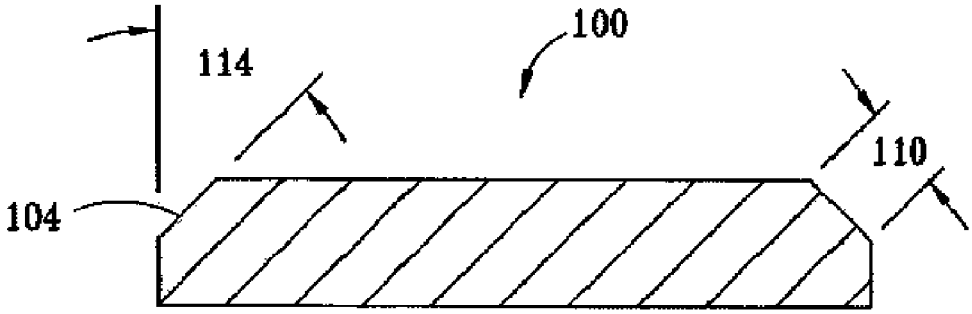

FIG. 6A shows an ultra hard top layer 100 for a cutter that has a shaped working surface 102 including a varied geometry chamfer 104 circumferentially around the cutting edge 106. The shaped working surface 102 is depicted as generally flat except for the shape of the chamfer 104. The chamfer 104 is varied in size circumferentially around the cutting edge 106 according to one embodiment of the present invention. The change in the size or the width of the chamfer is demonstrated in the elevation section views of FIGS. 6B and 6C taken along section lines B-B and C-C of FIG. 6A, respectively. In this embodiment the width 108 in FIG. 6B is smaller that the width 110 in FIG. 6C. The angle 112 of the chamfer at section B-B, FIG. 6B, is the same as angle 114 at section line C-C, FIG. 6C. In this embodiment, the chamfer geometry varies in terms of varied width and the angle does not change.

Figure 7A:
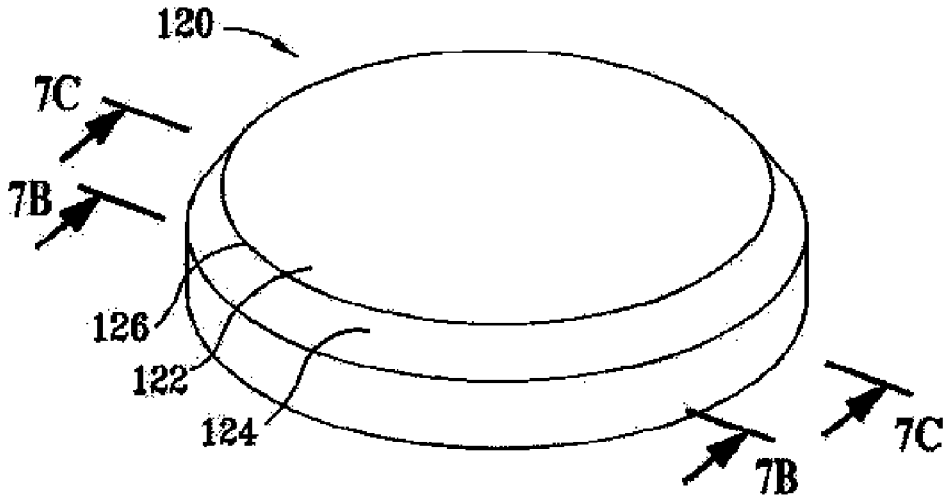
FIG. 7 is a perspective assembly view, represented by a three dimensional model, of another embodiment of a cutter having an alternative design of a varied chamfer geometry wherein the angle of the chamfer is varied circumferentially around the cutting edge according to another alternative aspect of the invention.
Figure 7B:
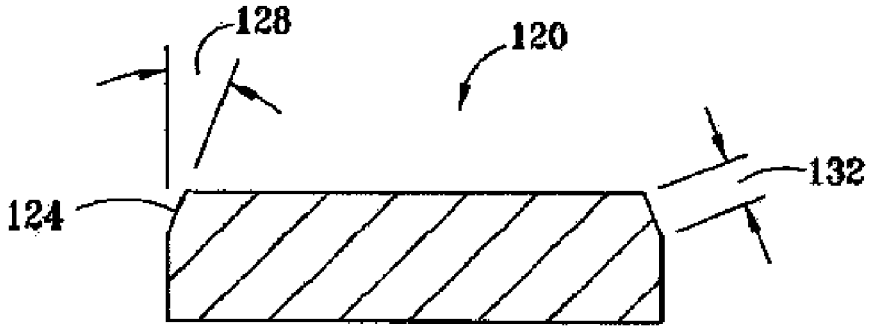
Figure 7C:
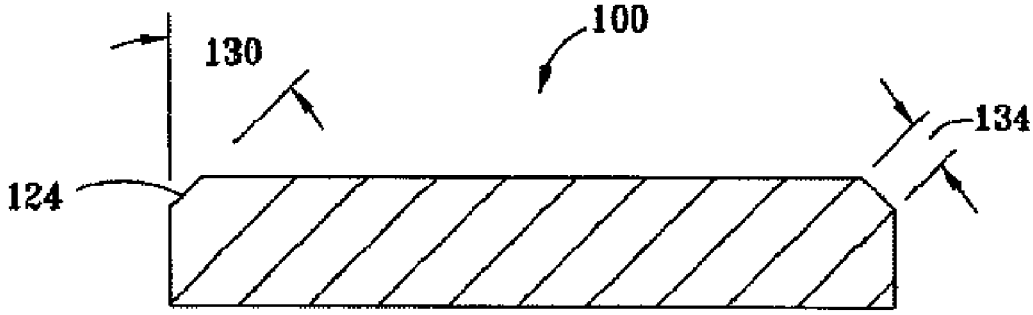

FIG. 7A shows another embodiment of an ultra hard top layer 120 for a cutter having an alternative design of a shaped working surface 122 including a varied geometry chamfer 124 wherein the angle of the chamfer 124 is varied circumferentially around the cutting edge 126 according to another aspect of the invention. The change in the angle of the chamfer is illustrated in FIGS. 7B and 7C. In this embodiment, the angle 128 in FIG. 7B is smaller than the angle 130 in FIG. 7C. The width 132 of the chamfer 124 at section B-B, FIG. 7B, is the same as the width 134 of the chamfer 124 at section line C-C, FIG. 7C. In this embodiment, the chamfer geometry varies in terms of varied angle and the width or size of the chamfer 124 does not change.

It will be understood that a varied geometry of a chamfer according to the invention could also be provided as a combination of varied size and varied angle. For purposes of convenience and clarity, the depictions in the drawing figures will primarily indicate varied chamfer geometry with change in size so that the variable nature of the chamfer geometry is discernable in the drawings.

Figure 8:
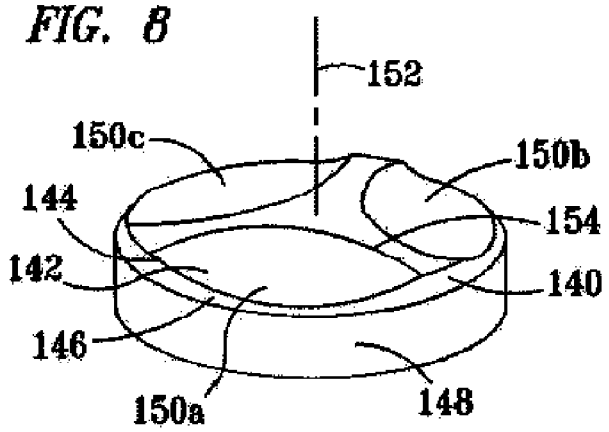
FIG. 8 is a perspective view of an ultra hard top layer with a shaped working surface and having a varied geometry chamfer circumferentially around the cutting edge of the working surface of the ultra hard layer according to another embodiment of the present invention.

FIG. 8 shows an alternative embodiment of an ultra hard top layer 140 for a cutter with a shaped working surface 142 and having a varied geometry chamfer 144 circumferentially around a cutting edge 146 at the intersection of the shaped working surface 142 and a side surface 148. The shaped working surface 142 includes one or more depressions 150*a*, 150*b*, and 150*c* extending radially outwardly to the cutting edge 146. While three depressions 150*a-c* are depicted uniformly spaced around the shaped working surface 142, fewer or a greater number with uniform or non-uniform spacing may be formed without departing from certain aspects of the invention. For example, one or more depressions 150*a-c* can be formed as one or more planar surfaces or facets in a face 154. Depending upon the embodiment, the face 154 may be a planar shaped surface, a dome shaped surface or a surface having another shape. The depressions 150*a-c* in this embodiment comprise planar surfaces or facets each at an obtuse angle relative to a central axis 152 of the cylindrical ultra hard top layer. The obtuse angle is different from the angle of other portions of the working surface, such that a relative depressed area defining the depressions 150*a-c* is formed the face 154. Where the surrounding portions of the face 154 are planar and at a 90-degree angle with respect to the axis of the cutter, the obtuse angle is generally greater than 90 degrees with respect to the axis 152 of the cutter. However, according to alternative embodiments of the invention, the obtuse angle may be less than 90 degrees. It will also be understood that in other alternative embodiments, each of the depressions 150*a-c* can be multi-faceted or comprised of multiple planar surfaces. Alternatively, the depressions 150*a-c* can also be formed with simple curved surfaces that may be concave or convex or can be formed with a plurality of curved surfaces or with a smooth complex curve.

The depressions 150*a-c* may be formed and shaped during the initial compaction of the ultra hard layer 140 or can be shaped after the ultra hard layer is formed, for example by Electro Discharge Machining (EDM) or by Electro Discharge Grinding (EDG). The ultra hard layer 140 may, for example, be formed as a polycrystalline diamond compact or a polycrystalline cubic boron nitride compact. Also, in selected embodiments, the ultra-hard layer may comprise a "thermally stable" layer. One type of thermally stable layer that may be used in embodiments of the present invention may be a TSP element or partially or fully leached polycrystalline diamond. The depressions 150*a-c* extend generally at an angle relative to the face 154 outward to the edge of the cutter. It has been found that a varied chamfer 144 can be conveniently made with a fixed angle and fixed depth EDM or EDG device. For example, a EDM device will typically cut deepest into the edge 146 where the raise areas of face 154 extend to the edge 146 and will cut less deep where the depressions 150*a-c* extend to the edge 146. The chamfer 144 is cut the least at the lowest edge point in each depression 150*a-c* and progressively deeper on either side of the lowest edge point. A varied width or size chamfer is conveniently formed circumferentially around the edge 146 of the ultra hard cutter layer 140. Alternatively, variable or programmable angle and depth EDM or EGM can be used to form the variable geometry chamfer.

During use, depending upon the embodiment of the invention, the average amount of chamfer, the angle of the chamfer, or both the amount and the angle of the chamfer will vary with different cutting depth. For example, a cutter in accordance with embodiments of the invention may have a region on the cutting surface with increasing chamfer contacting the formation when engaging in a deeper cut. The increased chamfer helps to "shoulder" the increased stress with the deeper cut.

Figure 9:
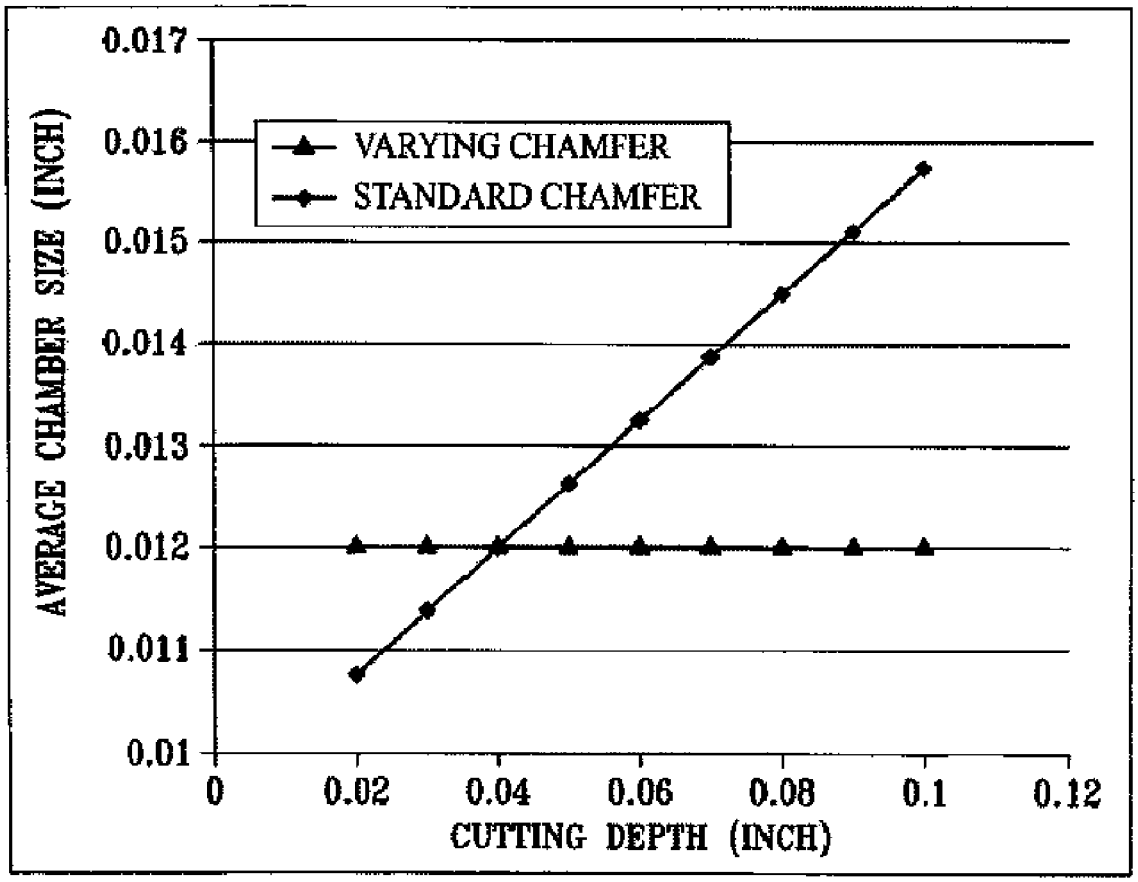
FIG. 9 is a graph showing the average chamfer size as varied with different cutting depths for a cutter having the varied chamfer ultra hard layer of FIG. 8 as compared to a cutter having fixed geometry chamfer.

FIG. 9 shows a graphical comparison of Average Chamfer Size vs. Cutting Depth, for a 16 mm cutter having the varied chamfer geometry according to a cutter formed with the ultra hard top layer of FIG. 8. A cutter with a small chamfer generally has good cutting efficiency. The varied chamfer cutter has a small average amount of chamfer toward the middle of the critical region (the area of the cutter surface or cutter surfaces engaged with the geological formation and under load). When using a varied chamfer cutter under normal drilling conditions, the cutting depth is confined or limited within a specified range and does not generally engage the formation beyond the depth at which the average chamfer is relatively small. Therefore, the variable chamfer on a cutting tool provides good cutting efficiency within the range of normal cutting depths. Under severe loading, such as impact with hard formation features or such as excessive tool pressure or weight on bit (WOB), the cutting depth increases beyond the range of normal cutting depths. The geometry of the chamfer is varied along the edge in the critical region so that the average chamfer size also varies with the depth of the cut.

In the embodiment considered with reference to FIG. 9, the chamfer is formed so that its size increases progressively on either side of the point of maximum contact and around the arc of the cutting edge in contact with the geological formation. The graph of FIG. 9 indicates that the average amount of the variable size chamfer in contact with the formation increases with the depth of the cut. The size of the variable chamfer is increased along the edge as the distance from the point of contact increases. Thus, when the cutter digs into the formation, a greater portion of the cutting edge has a larger chamfer to give more protection against chipping and spalling. The increased chamfer corresponds to and is encountered with the increased depth of cut so the chamfered portion of the cutter better shoulders the increased loading and therefore provides better protection to the cutter when greater protection is needed.

Similarly, the cutting characteristics change with the angle of the chamfer of a cutter. Where characteristics associated with different chamfer angles are desired under different loading conditions the chamfer angle can be varied on either side of the point of contact. For example, if a larger angle chamfer is desired under high loading conditions associated with deeper cutting depths, the angles of the chamfer can be made larger. Thus, the average angle of the chamfer will be larger when the cutting depth increases. Where the characteristics, of the chamfer associated with a smaller angle, as for example greater stability of a drill bit, are desired for deeper cutting depth, the angle of the chamfer can be varied to be a smaller angle on either side of the point of contact in the critical region. A combination of characteristics associated with varied width of chamfer and varied angle of chamfer can be obtained by varying the geometry of the chamfer with both changes in width and changes in the angle.

It should be understood that while the chamfer described herein is depicted as a straight angle truncated conical chamfer (i.e., a straight angled edge in cross-section); a radius chamfer (i.e., a curved edge in cross-section profile) is also contemplated within the scope of the invention.

Figure 10:
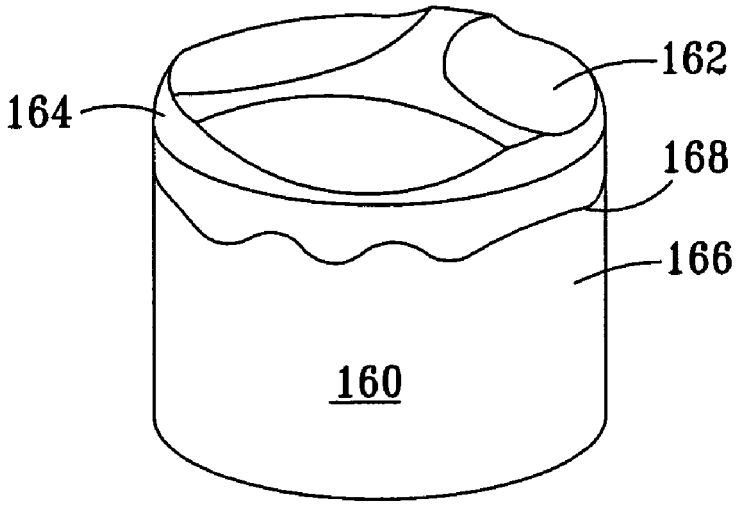
FIG. 10 is a perspective view represented by a three dimensional model of a cutter having an ultra hard layer with a shaped working surface bonded to a substrate at a non-planar interface according to one embodiment of the invention.

FIG. 10 shows a three-dimensional model of a cutter 160 having an ultra hard layer 162 with a shaped working surface 164. The ultra hard layer 162 is bonded to a substrate 166 at a non-planar interface 168 according to one embodiment of the invention.

Figure 11:
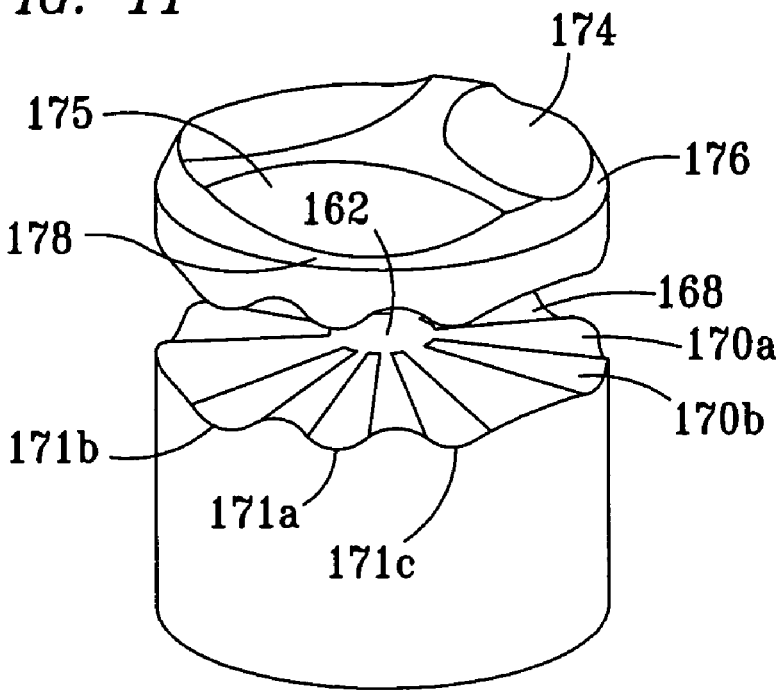
FIG. 11 is a perspective assembly view, represented by a three dimensional model, of the cutter of FIG. 10 showing the contours of a non-planar interface according to one embodiment of the invention.

FIG. 11 shows a three dimensional model, of the cutter 160 of FIG. 10 showing the contours 170*a-c* and another set of contours 171*a-c* of a non-planar interface 168 according to one embodiment of the invention. Each set of contours 170*a-c* and 171*a-c* is oriented with one of a plurality of depressions 174 and 175 at the intended critical regions 176 and 178 respectively. It will be understood with reference to FIG. 11 that where there are additional depressions, such as a third depression 173, a corresponding third set of contours 172*a-c* (not fully shown in FIG. 11) will be provided. The deepest contours 170*a* and 171*a* are oriented with the deepest portion of the depressions 174 and 175 along the cutting edge and at the point of maximum cutting contact in the critical regions. The presence of contours 170*a-c*, 171*a-c* and 172*a-c* provide additional bonding surface area that resists shear forces and delamination at the interface. The contours also provide a peak and valley geometry at the NPI 168 that also resists shear forces and delamination at the interface. The contours further serve to interrupt potential crack propagation through the ultra hard layer. Horizontal cracks initiated in the ultra hard layer in the valleys will generally stop propagating when the crack encounters the substrate at the peaks. The deep contours 170*a* and 171*a* (and 173*a* not shown) of each set of contours in the substrate 166 also are deepest toward the outer circumference of the substrate 166. This forms an angled support surface for the ultra hard layer that is oriented with the point of maximum loading contact. The angled support surface is at an angle that is more nearly perpendicular to the primary force vector caused by cutting load. Thus, increased portion of the load is supported by the substrate with compaction strength and a decreased portion of the load is supported by the substrate with shear strength. Further, it has been discovered that with the increased surface area and the deepest part of the contours at the point of maximum loading, thermal distribution and heat dissipation is facilitated.

Figure 12:
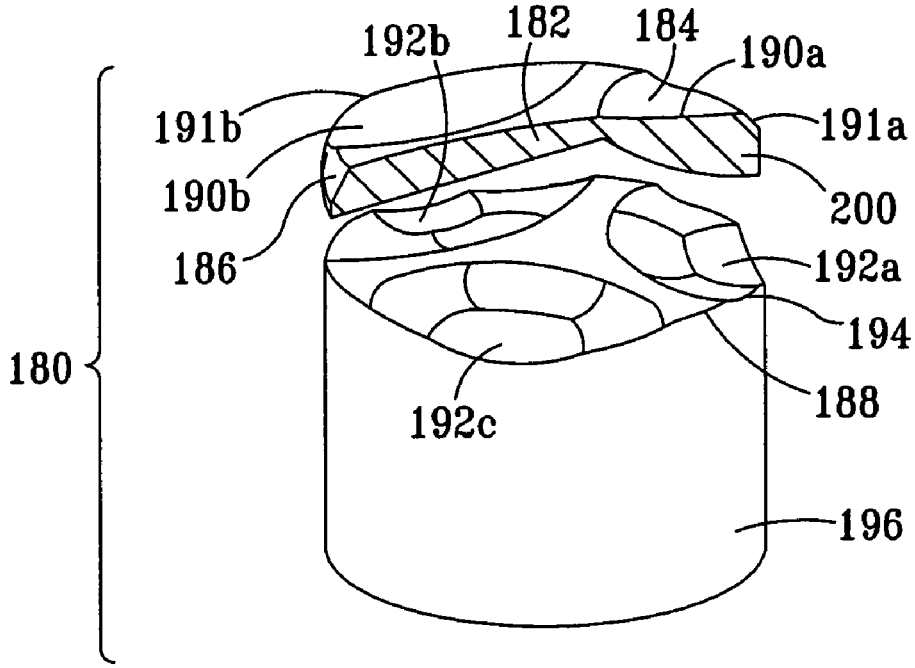
FIG. 12 is a perspective assembly view, represented by a three dimensional model, of another embodiment of a cutter having a shaped working surface with varied chamfer geometry and an alternative configuration of a non-planar interface according to alternative aspects of the invention.

FIG. 12 shows an assembly view of another embodiment of a cutter 180 having an ultra hard layer 182 with a shaped working surface 184 including a varied chamfer geometry 186 and an alternative configuration of a non-planar interface 188. This cutter 180 is formed with a plurality of depressions 190*a*, 190*b*, and 190*c* (190*c* not shown), each corresponding to a potential critical cutting region 191*a-b*. Only one depression 190*a* (or 190*b* or 190*c*), corresponding to one critical region 191*a* (or 191*b* or 191*c*), will be oriented for cutting a geological formation when the cutter 180 is brazed to a drill bit (not shown in FIG. 12). When a sufficient number of cutters 180 are damaged in the selected depression 190*a* so that the effectiveness of the drill bit is diminished, the drill bit can be run out of the hole and the cutters 180 can be removed, rotated, and re-brazed to the drill bit with an undamaged depression 190*b* (or 190*c*) oriented in proper cutting position. Thus, in many instances the drill bit can be refurbished by reusing some or all of the same cutters 180.

Figure 13:
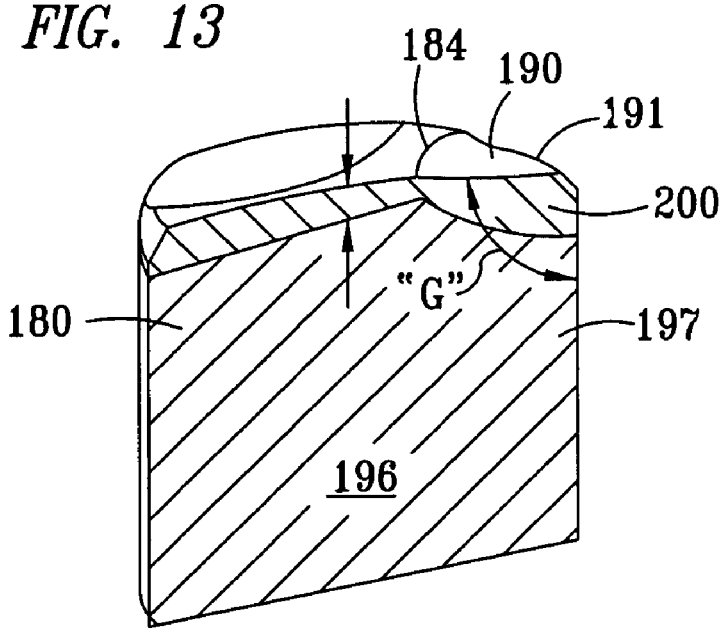
FIG. 13 is a perspective section view, represented by a sectioned three dimensional model, of the cutter of FIG. 12 showing a varied thickness of the ultra hard layer oriented on the non-planar interface for increased thickness at a depression of the shaped working surface according to another alternative aspect of one embodiment of the invention.

According to other aspects of the invention, the non-planar interface 188 is formed with depressed areas 192*a-b* in the upper surface 193 of the substrate 196, and oriented with the depressions 190*a-b* that are formed in the shaped working surface 182. According to these alternative aspects of the invention, the average depth of the depressed area 192 at the outer periphery 194 of the cutter body 196 is greater than the average depth of the depressed areas 192 of the non-planar interface 188 at locations away from the point of maximum load in the critical region 191. In the alternative embodiment depicted in FIG. 12, a plurality of depressed areas 192*a-b* are formed in the non-planar interface 188 and the maximum depth of each depressed area 192 in the non-planer interface 188 corresponds to the position of the maximum edge depth of each of the plurality of working surface depressions 190*a-b*. This results in varied thickness of the ultra hard layer, with the thickest portion 200 of the ultra hard layer 184 positioned adjacent the critical area 191 of the shaped working surface 182. It has also been found to be useful, according to alternative embodiments of the invention, to provide the ultra hard layer with a minimum thickness 202 of about 0.040 inch and the maximum thickness at the thickest portion 200 of about 0.160 inch. This maintains residual thermal stress in the ultra hard layer within acceptable limits FIG. 13 shows a varied thickness of the ultra hard layer 184 oriented on the non-planar interface of the cutter 180 of FIG. 12. There is an increased thickness at each depression 190*a-b* of the shaped working surface 182. It can be understood that the depressions 190*a-b* in the working surface 182 result in an easy-to-form varied chamfer 186 and also provides an increased angle "G" greater than 90 degrees between the side of the cutter body 197 and the shaped working 182 surface. To provide back rake angles on existing drill bits within certain acceptable ranges, it has also been found to be useful to form the angle G within a range of about 91 degrees to about 130 degrees. By having the non-planar interface 188 also deeper at the outer periphery 194 and in the critical region 191, the ultra hard layer 184 is also thicker at the periphery edge in the critical region 191. Moreover, the upper surface 193 of the substrate 196 effectively provides support to the ultra hard layer 184 at an increased angle relative to the load caused by cutting contact with the formation (i.e. at the maximum load point, the upper surface 193 is at an angle that is more nearly normal to the vector of the load force). Thus, during use, a greater portion of the cutting force or load is supported by compression on the angled surface 193 of the substrate 196 and tangential shear forces support a smaller portion of the load. Reduction in tangential shearing forces has been found to reduce spalling and delaminating. The shaped working surface also has a larger area for convective cooling such that the adverse effects of heavy loading are reduced.

Finite element analysis shows that the varying chamfer can reduce the stress at the cutting edge and the outer diameter of the ultra hard layer or diamond table.

Figure 14:
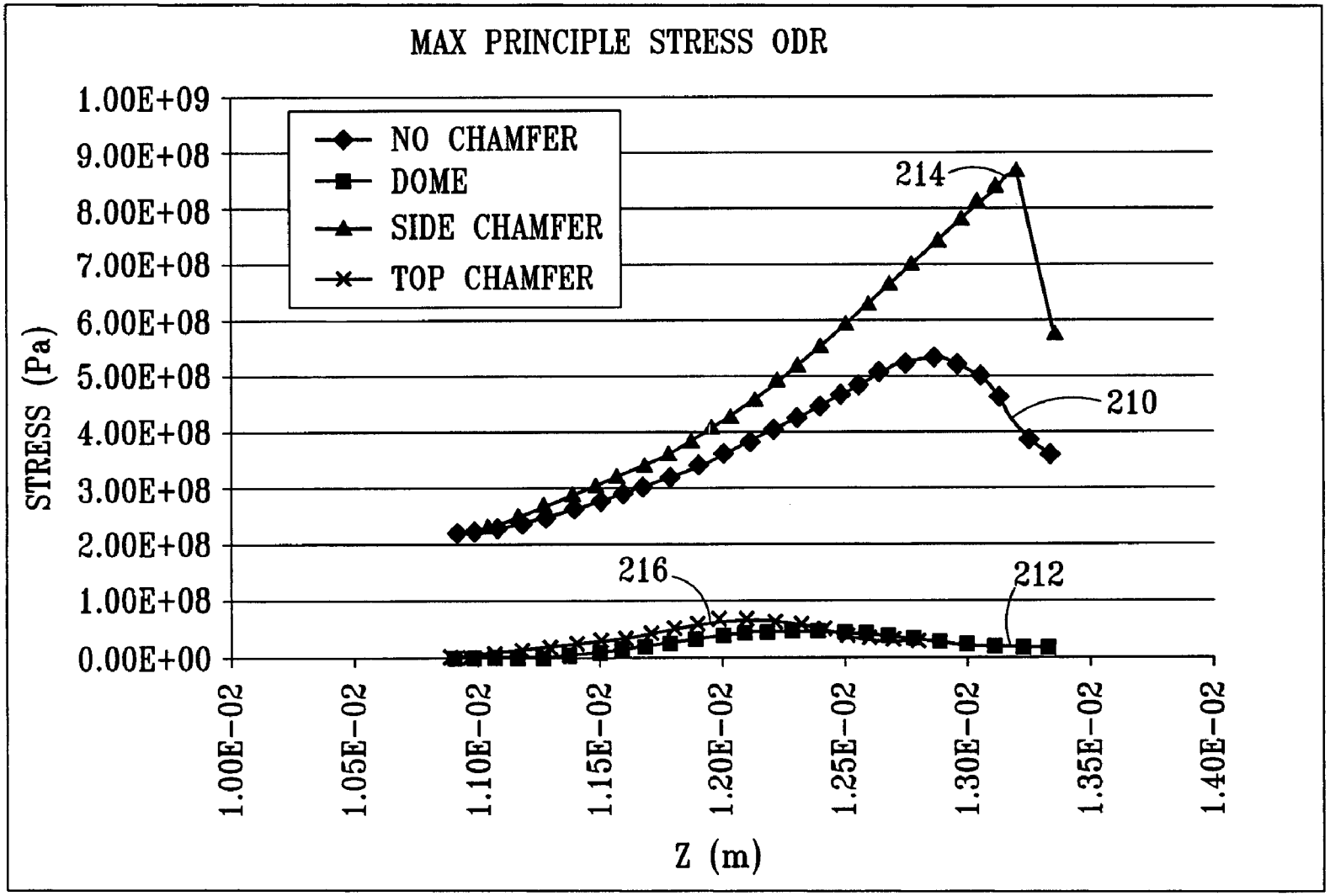
FIG. 14 is a graph of maximum principle stress plotted along the "z" axis of a cutter and comparing the results for a cutter with no chamfer, a cutter with a dome shaped working surface, and a cutter with side chamfer all compared to a cutter with top chamfer according to alternative aspects of the present invention.

FIG. 14 shows a diagram of maximum principle stress plotted along the "z" axis of a cutter and comparing the results for a cutter with no chamfer (curve 210), a cutter with a dome shaped working surface (curve 212), and a cutter with side chamfer (curve 214), compared to a cutter with top chamfer (curve 216) according to the present invention. It is clear from this comparison that top chamfer provides very effective relief of the maximum principle stress ODR.

Figure 15:
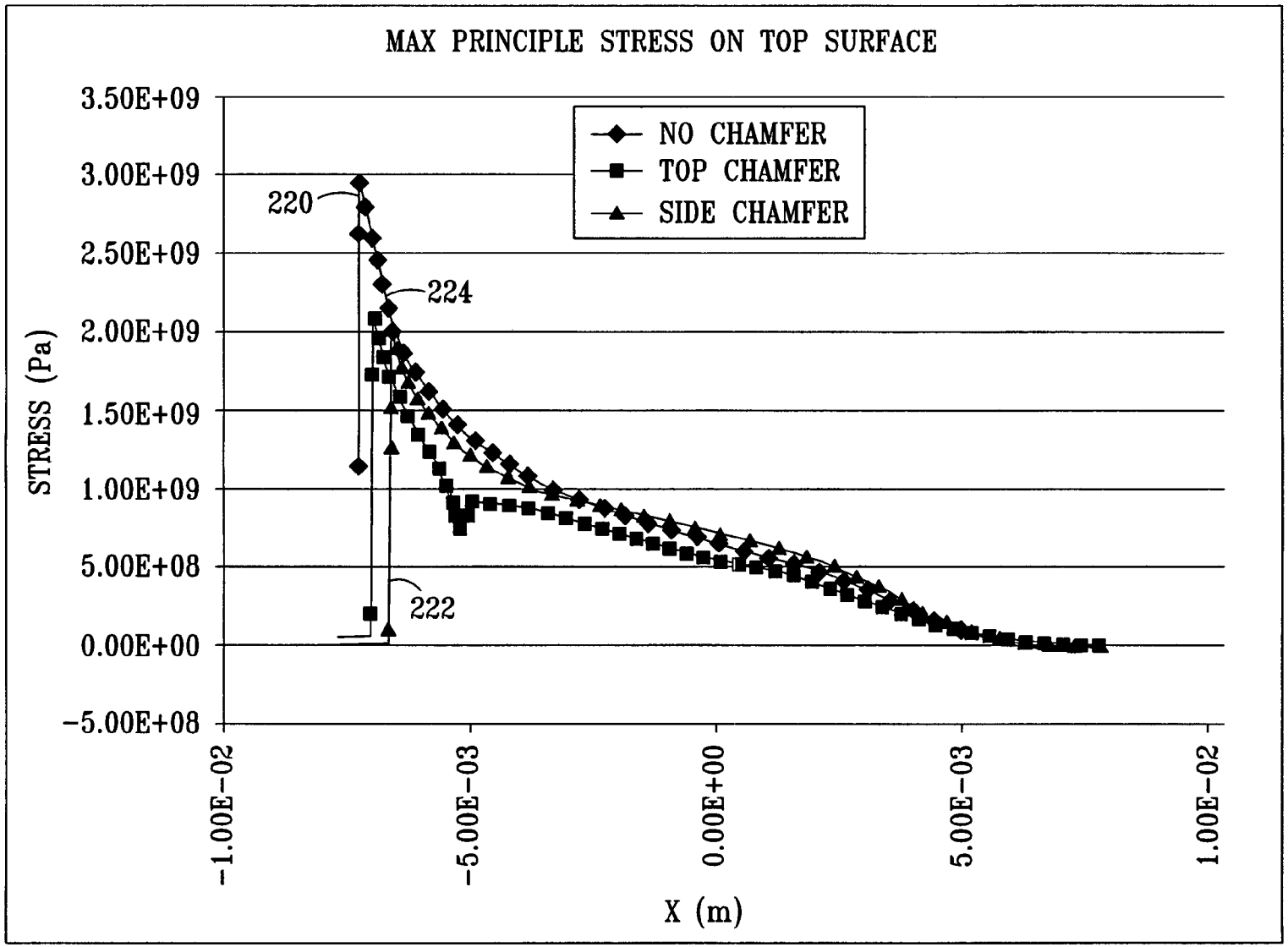
FIG. 15 is a graph of maximum principle stress on the top surface plotted along the "x" axis of a cutter with no chamfer, and a cutter with side chamfer compared to a cutter with top chamfer according to alternative aspects of the present invention.

FIG. 15 shows a diagram of maximum principle stress on the top surface plotted along the "x" axis of a cutter with no chamfer (curve 220) and a cutter with side chamfer (curve 222), compared to a cutter with top chamfer (curve 224) according to the present invention. It is clear from this comparison that both top chamfer and side chamfer provide significant relief of the maximum principle stress on the top surface.

The comparisons illustrated in FIGS. 14 and 15, show that the cutter according to this example has resistance to chipping and spalling.

Also, increasing chamfer size can prevent the bit from drilling too aggressively when the cutter cuts an excessive depth (e.g., when encountering a soft formation), hence, drilling stability for the whole bit is improved. In accordance with embodiments of the invention, the chamfer with or angle varies in the critical region. The variable chamfer can be established during manufacture. The variable chamfer in the cutting region can be appropriately adjusted, as it would be with a constant size chamfer. Increasing the size or angle of the chamfer outside the center of the critical region does not interfere with the drilling efficiency in standard drilling. In situations where the formation changes with depth or location, the variable chamfer provides protection to the cutters under various drilling conditions, and the overall efficiency of the cutters with a variable chamfer can remain substantially the same. Thus, a variable chamfer can have a minimum influence on drilling efficiency or normal energy consumption, while increasing drilling stability and improving the endurance and useful life of the ultra hard cutter.

Figure 16:
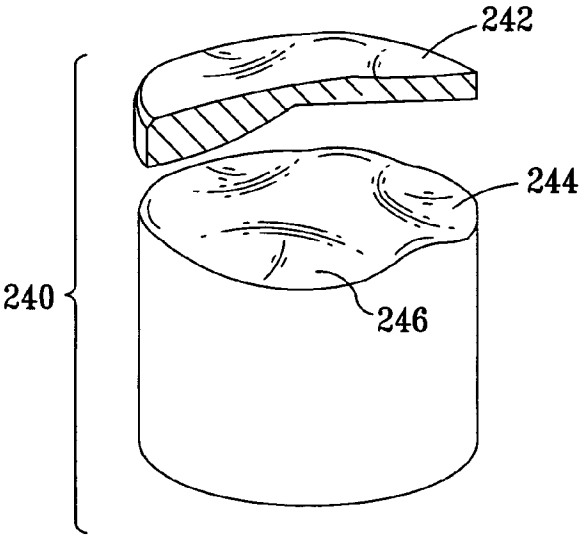
FIG. 16 is a perspective assembly view, represented by a three dimensional model, of another embodiment of a cutter having a shaped working surface with varied chamfer geometry and an alternative configuration of a non-planar interface according to alternative aspects of the invention.

FIG. 16 shows another alternative embodiment of a cutter 240 having a shaped working surface 242 with varied chamfer geometry 244 and an alternative configuration of a non-planar interface 246 according to aspects of the invention.

Figure 17:
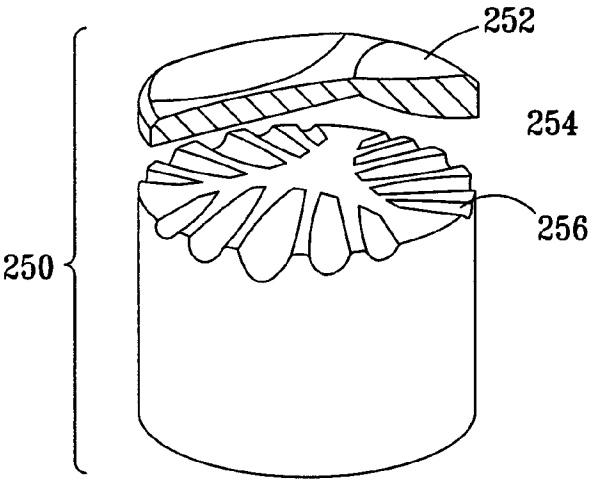
FIG. 17 is a perspective assembly view, represented by a three dimensional model, of another embodiment of a cutter having a shaped working surface with varied chamfer geometry and an alternative configuration of a non-planar interface according to alternative aspects of the invention.

FIG. 17 shows another alternative embodiment of a cutter 250 having a shaped working surface 252 with varied chamfer geometry 254 and an alternative configuration of a non-planar interface 256 according to aspects of the invention.

Figure 18:
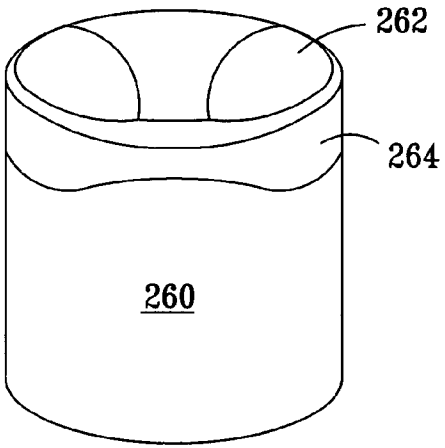
FIG. 18 is a perspective assembly view, represented by a three dimensional model, of another embodiment of a cutter having an alternative design of a shaped working surface with varied chamfer geometry according to alternative aspects of the invention.

FIG. 18 shows another alternative embodiment of a cutter 260 having an alternative design of a shaped working surface 262 with varied chamfer geometry 264 according to aspects of the invention.

Figure 19:
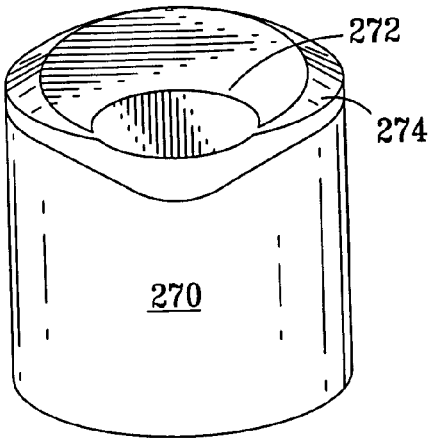
FIG. 19 is a perspective assembly view, represented by a three dimensional model, of another embodiment of a cutter having an alternative design of a shaped working surface with varied chamfer geometry according to alternative aspects of the invention.

FIG. 19 shows another alternative embodiment of a cutter 270 having an alternative design of a shaped working surface 272 with varied chamfer geometry 274 according to an alternative embodiment of the invention of the invention.

Figure 20:
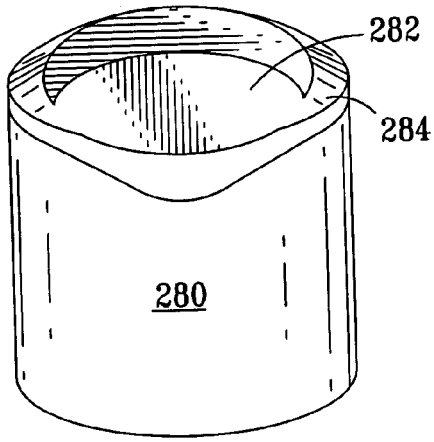
FIG. 20 is a perspective assembly view, represented by a three dimensional model, of another embodiment of a cutter having an alternative design of a shaped working surface with varied chamfer geometry according to alternative aspects of the invention.

FIG. 20 shows another alternative embodiment of a cutter 280 having an alternative design of a shaped working surface 282 with varied chamfer geometry 284 according to certain aspects of the invention as depicted.

Figure 21:
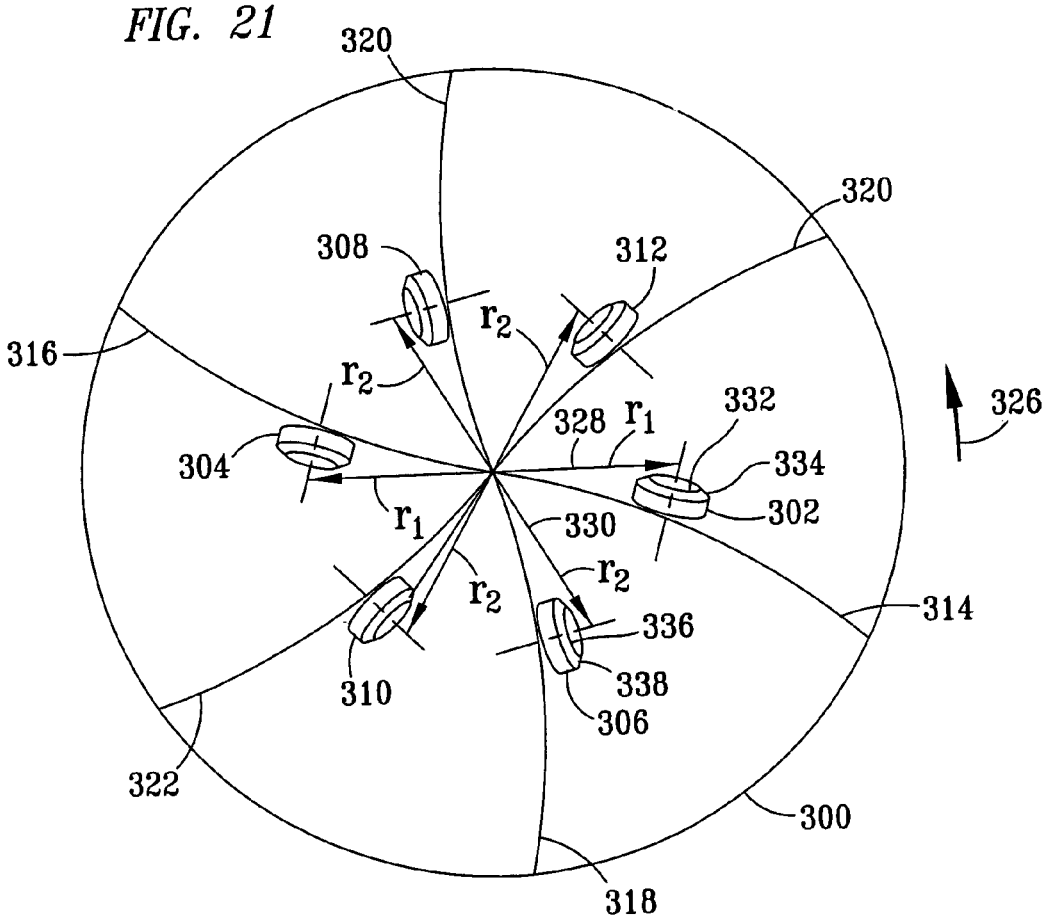
FIG. 21 is a schematic depiction of cutters at selected radial positions on blades of a hypothetical drill bit to demonstrate opposed dual set cutters and leading-trailing dual set cutters.

FIG. 21 schematically shows an example of a hypothetical drill bit 300 with selected cutters 302, 304,306, 308, 310 and 312 at selected radial positions r1 and r2 on blades 314, 316, 318, 320, 322, and 324, respectively. The blades are schematically represented by lines tracing the blade profile in this end view. Cutters 302 and 304 are at the same radial positions r1 from the center of the drill bit face, such that cutters 302 and 304 demonstrate opposed dual set cutters. Assuming the blade profile shape is the same for opposed blades 314 and 316, the opposed dual set cutters 302 and 304 will each cut in spiral paths having the same shape and at the same depth depending upon the ROP and RPM of the drill bit. Cutters 306 and 308 are similarly opposed dual set cutters each at a position defined by radius r1 and the profile shape of the blades 318 and 320 respectively. In this example cutters 306 and 308 are also leading cutters because they are followed during drilling by trailing cutters 310 and 312, each at the same radius r2 on the blades 322 and 324. Trailing blades 322 and 324 follow leading blades 318 and 320, respectively, in the direction of cutting 326. Thus, assuming the blades have the same profile shape, the trailing dual set cutter 310 will follow in the same spiral path as the leading cutter 306 and the trailing cutter 312 will follow in the same spiral path as leading cutter 308. Because the leading cutters 306 and 308 traverses a greater cutting distance as they cut into the formation, compared to the cutting distance traversed by the trailing cutters 310 and 312, the leading cutters 306 and 308 will have a greater depth of cut than the trailing cutters 310 and 312. It has been found by the inventors to be useful according to one embodiment of the invention that varying the chamfer and having a different geometry chamfer for a leading cutter and a trailing cutter. For example, a leading cutter that cuts deeper than a corresponding trailing cutter may benefit from a larger chamfer that can effectively increase the back rake angle to help protect the working surface from delaminating, chipping, and spalling as discussed above.

Figure 22:
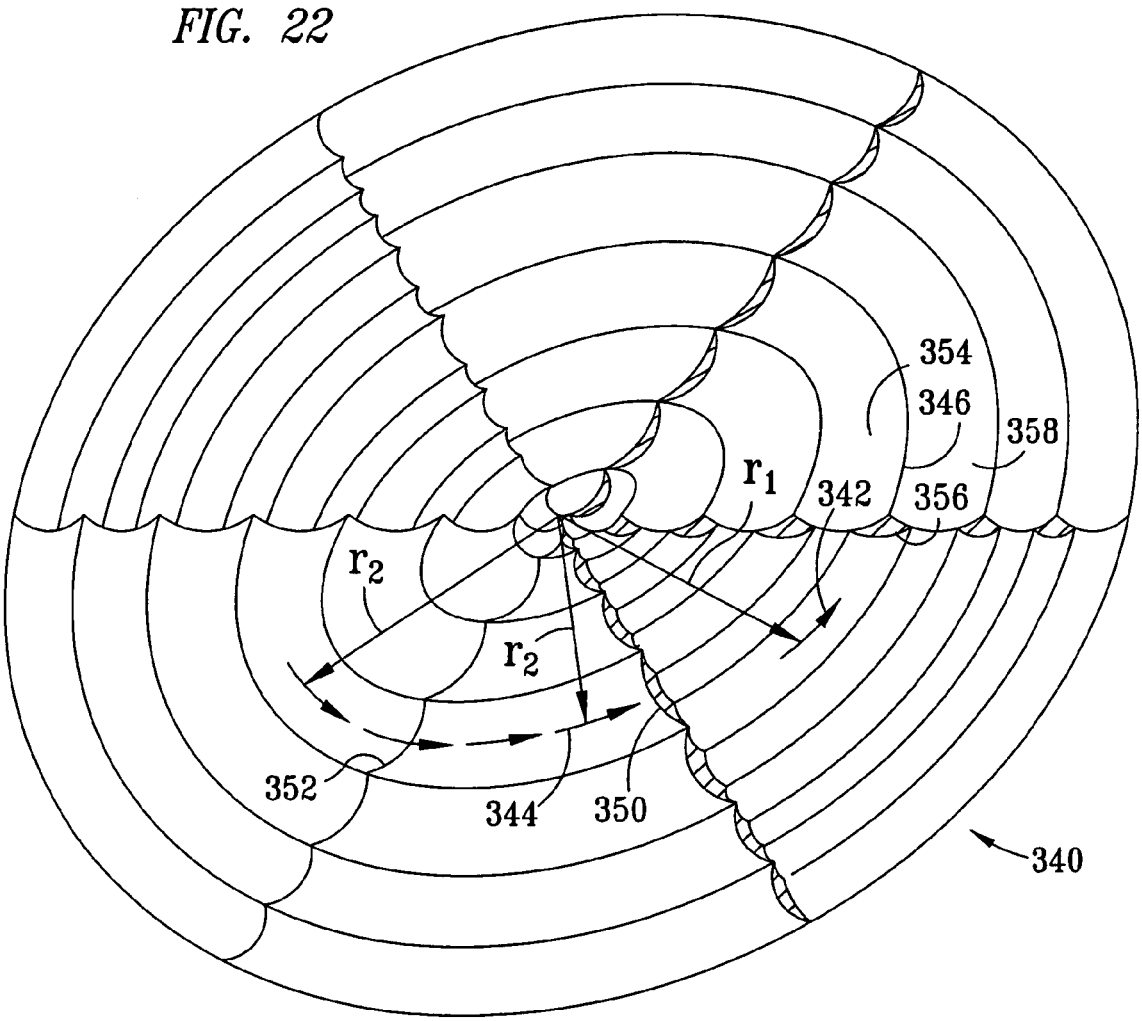
FIG. 22 is a schematic perspective view of a predicted partial bottom hole cutting pattern for a hypothetical drill bit with dual set cutter placement similar to the placement shown in FIG. 21.

FIG. 22 shows an example of a predicted partial bottom hole cutting pattern 340 for a hypothetical drill bit with repeated dual set cutter placement similar to the placement shown in FIG. 21. For example, cutter 302 of FIG. 21 at radius r1 produces a cutting path 342. The cutting path 342 traveled by cutter 302 is offset from a trough 354 formed by cutter 306 so that the ridge 346 between adjacent cutting paths 354 and 358 is engaged by a central portion of cutter 302. Cutter 306 of FIG. 21 produces a cutting path 344 at radius r2 and trailing cutter 310 follows along the cutting path at radius r2 cutting only slightly deeper than leading cutter 306. A cut engagement shape 348 shows the interface between the cutter 302 and the formation. Similarly the engagement shape 350 shows the cutter/formation engagement interface formed by the leading cutter 306. shape 350 is predicted in this embodiment to have a deep central area and shallower sides. A more uniform arc shape cutter/formation interface would be encountered by the trailing cutter 310 of FIG. 21. One reason for a trailing dual set cutter is to retain a sharp cutting edge in the event the leading cutter is damaged or in the event that an unexpected increase in depth of cut or ROP occurs while drilling. The shallow depth of cut therefore reduces that stress and wear on the trailing cutter so that it remains sharp.

Figure 23:
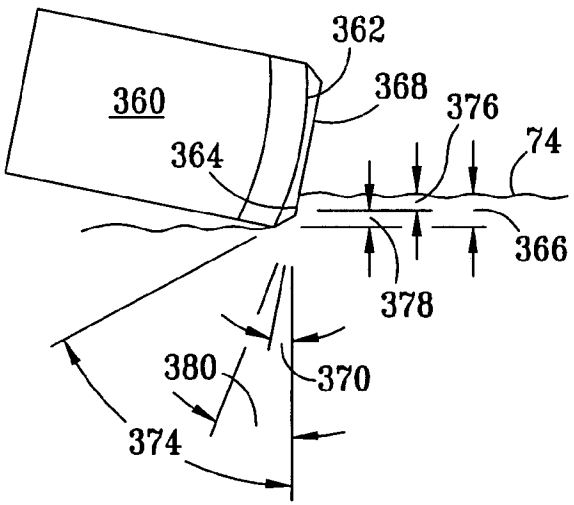
FIG. 23 is a partial side view of a cutter with a chamfer engaged in drilling a formation at a bottom hole and showing a theoretical effective back rake angle produced by the combined working face and the portion of a variable chamfer engaged in the formation.
Figure 26D:
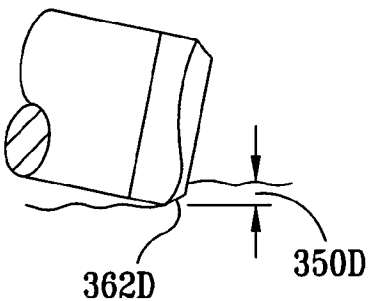
FIG. 26A-D shows a series of side views of the cutter of FIG. 25 with various portions of the chamfer engaged at different depths predicted for the cutter/formation engagement pattern of FIG. 24.
Figure 26C:
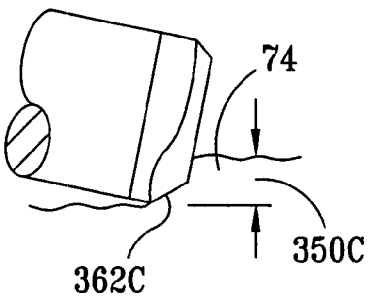
Figure 26B:
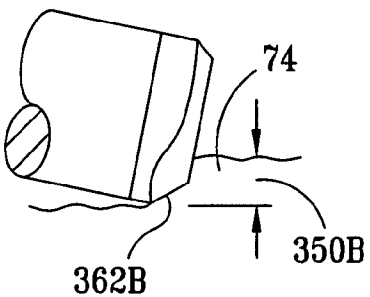
Figure 26A:
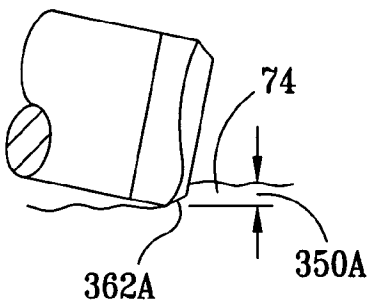

FIG. 23 shows an example of a cutter 360 with a variable size chamfer 362. A portion 364 of the chamfer 362 is engaged in drilling a formation 74 at a bottom hole with a depth of cut 366. The working face 368 defines a back rake angle 370 relative to a perpendicular 372 to the formation surface. It has been found by the inventors that the chamfer forms a chamfer back rake angle 374 that is larger than the faced back rake angle 370. The percentage the face engaged with the formation 74, as may be indicated by the depth 376 relative to the total depth 366, and the percentage of the chamfer 362 that is engage with formation 74, as may be indicated by the depth 378 depth relative to the total depth 366, gives an effective back rake angle 380. The effective back rake angle can be considered for purposes of approximating the cutting forces on the cutter and the stress and wear. It will be understood by those skilled in the art based upon this disclosure that specific calculations of the areas and back rake angles of the face component and the chamfer component can also be made and the calculated results combined to give the effective forces and the effective stress with very similar results in most cases. The theoretical effective back rake angle produced by the combined working face and the portion of a variable chamfer engaged in the formation is further helpful for understanding the usefulness of a variable chamfer designed, selected, or otherwise provided in accordance with the shape of the cutter/formation interface, or for purposes of matching the desired back rake angle to the depth cut along any portion of the cutter.

Figure 24:
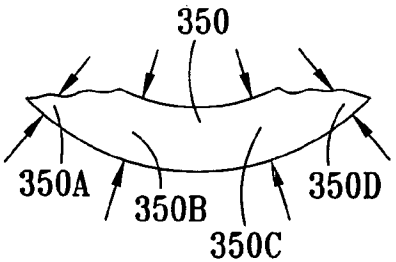
FIG. 24 is a schematic depiction of a predicted cutter/formation engagement pattern for a leading cutter in a dual set drill bit.

FIG. 24 shows a predicted cutter/formation engagement pattern 350 or shape (as shown in FIG. 22) for a leading cutter 306 in an example dual set drill bit 300 (shown in FIG. 21). There are depths at 350A, 350B, 350C and 350D along the interface pattern 350.

Figure 25:
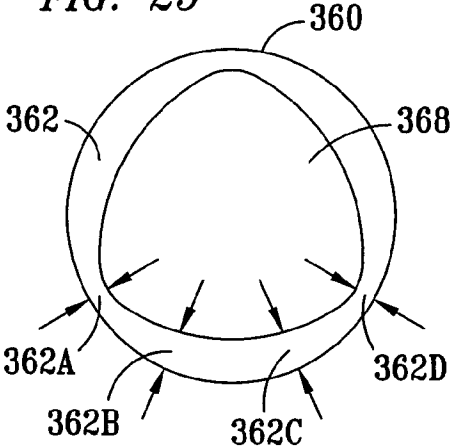
FIG. 25 is a top view of the face of an example of a variable chamfer cutter for a leading cutter in a dual set drill bit useful for the cutter/formation pattern according to one embodiment of the invention.

FIG. 25 is a top view of an example of the face 368 and a variable chamfer 362 for a cutter 360 according to one embodiment of the invention. The cutter may correspond to or may usefully replace a leading cutter 306 in a dual set drill bit. In this embodiment the size of the chamfer is made to vary in width. A width 362A is relatively narrow to correspond to the shallow depth 350A. Widths 362B and 362C are relatively wider to correspond to the deep cut depths 350B and 350C. A width 362D is relatively narrow corresponding to the shallow depth 350D. (The depths are shown in FIG. 24).

FIG. 26A-D shows a series of side views of the cutter 360 of FIG. 25 each at different points around the engaged cutter edge so that various portions 362A, 362B, 362C, and 362D of the chamfer 362 and the face 368 are shown engaged at different depths 350A, 350B, 350C, and 350D as predicted for the cutter/formation engagement pattern 350 of FIG. 24.

Figure 27:
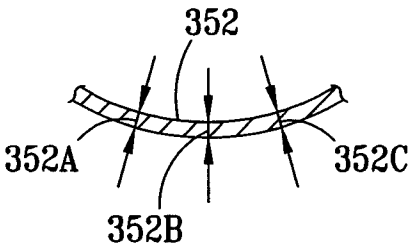
FIG. 27 is a schematic depiction of a predicted cutter/formation engagement pattern for a leading cutter in a dual set drill bit.

FIG. 27 shows an alternatively predicted cutter/formation engagement pattern 352 for a trailing cutter in a dual set drill bit. The shape of the pattern 352 is characterized by shallow depth of cut along the entire engaged critical area. For example depth 352A, 352B, and 352C are all about equal in this embodiment.

Figure 28:
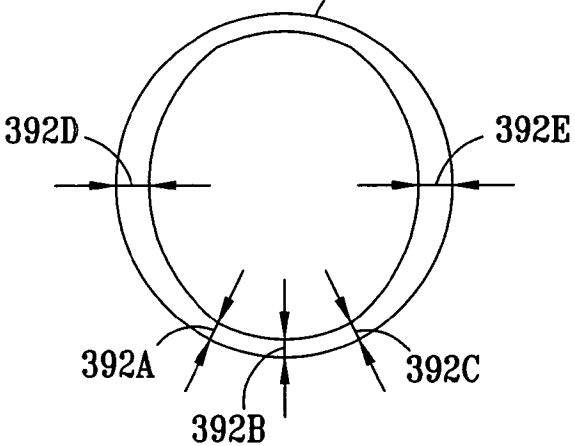
FIG. 28 is a top view of the face of an example of a variable chamfer cutter for a trailing cutter in a dual set drill bit useful for the cutter/formation pattern of FIG. 27 according to one embodiment of the invention.

FIG. 28 shows an example of a variable chamfer cutter 390 for a trailing cutter in a dual set drill bit similar to the cutter 310 in FIG. 21 that is useful for the cutter/formation pattern 352 of FIG. 27 according to one embodiment of the invention. A face 392 is circumscribed by a chamfer 392. The chamfer has substantially constant widths 392A, 392B, and 392C in the area corresponding to the predicted cut pattern 350. Those skilled in the art will understand based upon the entire disclosure that chamfer widths 392D and 392E may usefully vary for other purposes, for example so that unexpected deeper cuts are met with increased chamfer size as described above and as further indicated in connection with FIG. 29D below.

Figure 29D:
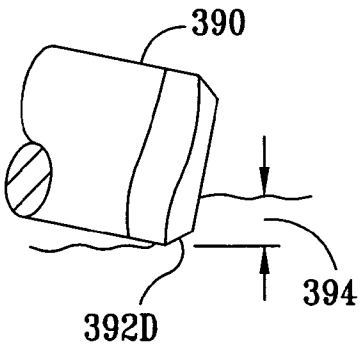
FIG. 29D is a side view of a cutter having a variable chamfer engaged at a greater depth than the typically predicted depth for the expected cutter/formation engagement pattern of FIG. 27 under normal conditions.
Figure 29C:
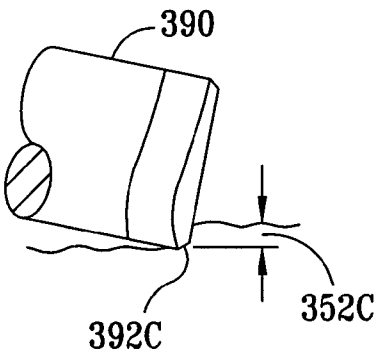
FIG. 29A-C shows a series of side views of the trailing cutter of FIG. 28 with various portions of the chamfer engaged at different depths predicted for the cutter/formation engagement pattern of FIG. 27.
Figure 29B:
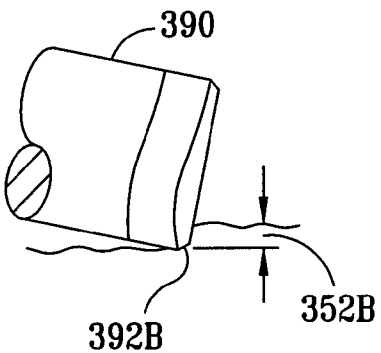
Figure 29A:
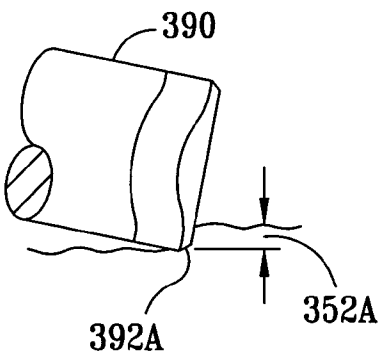

FIG. 29A-C shows a series of side views of the trailing cutter 390 of FIG. 28 with various portions of the chamfer 392A, 392B, and 392C, respectively, engaged at different depths 352A, 352B, and 352C as predicted for the cutter/formation engagement pattern 352 of FIG. 27.

FIG. 29D is a side view of the cutter 390 having a variable chamfer 392 engaged at a depth 394 greater than the typically predicted depths 352A-C for the expected cutter/formation engagement pattern 352 of FIG. 27 under normal conditions. Thus, for example, a wider chamfer portion 392D may act to reduce the effective back rake angle when unexpected deep cutting occurs. This can helps to reduce gouging into the formation, it can direct the flow of formation cuttings, and it can reduce the impact of a sudden deeper cut, and can help limit the further increase in depth of cut.

Figure 30:
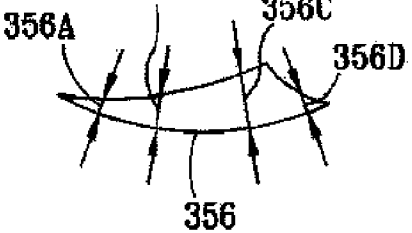
FIG. 30 is a schematic depiction of an example of a predicted cutter/formation engagement pattern for a cutter offset from a preceding cutter in a drill bit.
Figure 32D:
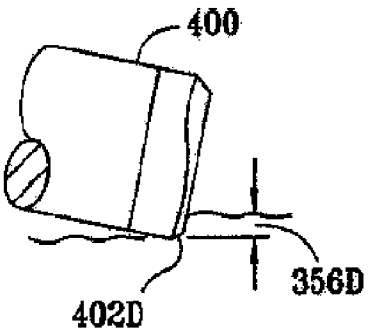
FIG. 32A-D shows a series of side views of the cutter of FIG. 32 with various portions of the chamfer engaged at different depths predicted for the cutter/formation engagement pattern of FIG. 31.
Figure 32C:
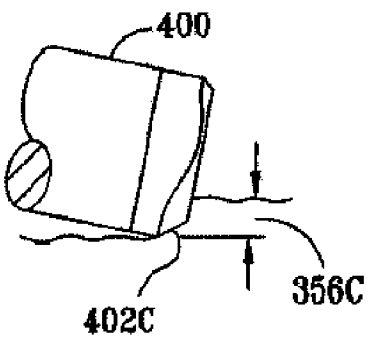
Figure 32B:
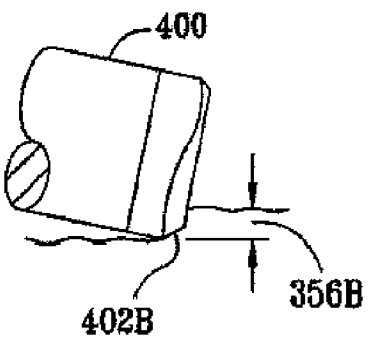
Figure 32A:
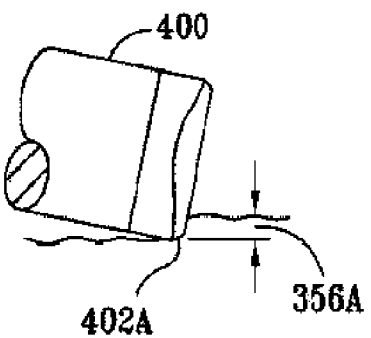

FIG. 30 shows an example of a predicted cutter/formation engagement pattern 356 or shape (as shown in FIG. 22) for a cutter, similar to cutter 302 as in an example drill bit 300 (shown in FIG. 21), that might be offset radially from a preceding cutter. The pattern 356 shows varying depths at 356A, 356B, 356C and 356D along the critical area of engagement with a formation.

Figure 31:
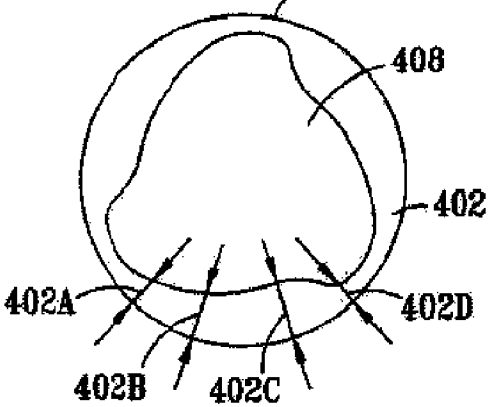
FIG. 31 is a top view of the face of an example of a variable chamfer cutter for a drill bit useful for the cutter/formation pattern of FIG. 31 according to one embodiment of the invention.

FIG. 31 is a top view of an example of the face 408 and a variable chamfer 402 for a cutter 400 according to one embodiment of the invention. The cutter 400 may correspond to or may usefully replace an offset cutter 302 in an opposed cutter dual set drill bit or might be any cutter that is offset from the path of a preceding cutter. In this embodiment the size of the chamfer 402 is made to vary in width. A width 402A is relatively narrow to correspond to the shallow depth 356A. Widths 402B and 402C are relatively wider to correspond to the deep cut depths 356B and 356C. A width 402D is relatively narrow corresponding to the shallow depth 356D. (The depths are shown in FIG. 30).

FIGS. 32A-D show a series of side views of the cutter 400 of FIG. 32 each at different points around the engaged cutter edge so that various portions 402A, 402B, 402C, and 402D of the chamfer 402 and the face 408 are shown engaged at different depths 356A, 356B, 356C, and 356D as predicted for the cutter/formation engagement pattern 356 of FIG. 30.

Figure 33:
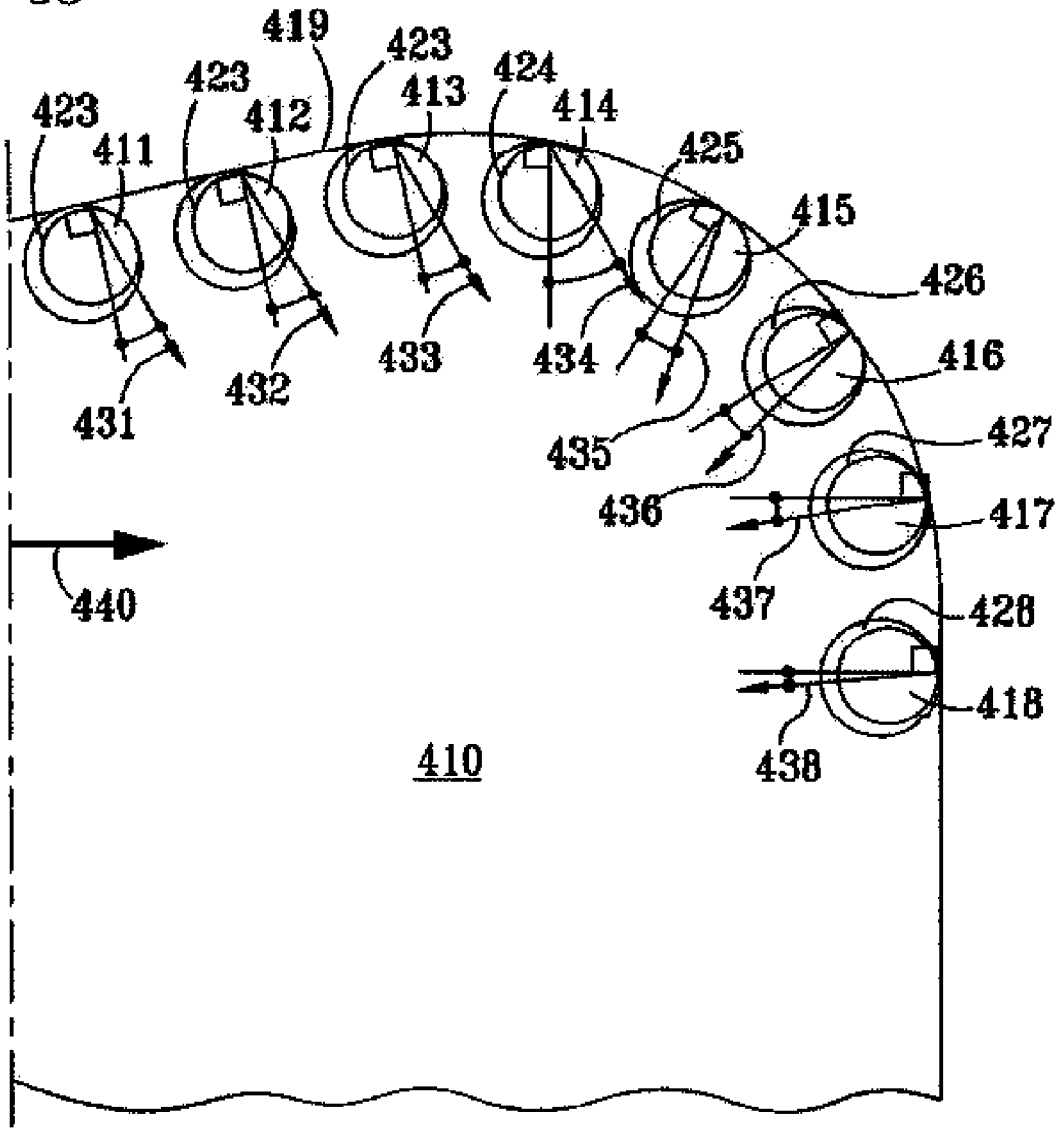
FIG. 33 is a schematic depiction of a cutter profile for one blade of a drill bit cutter showing an example of a plurality of varied chamfer cutters arranged to provide force on the cutters in a direction at an angle other than normal to the engaged formation surface so that a total side force results on the drill bit.
Figure 8:
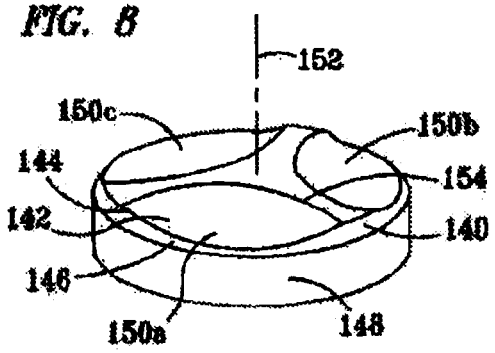
Figure 9:
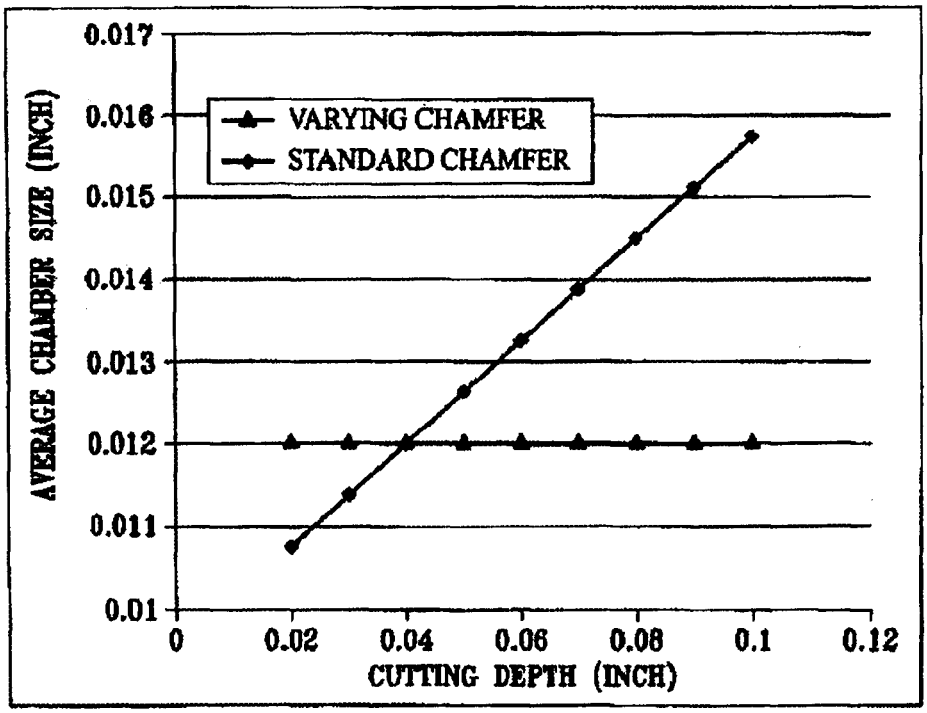

FIG. 33 shows an example of a drill bit 410 having a plurality of cutters 411, 412, 413, 414, 415, 416, 417, and 418. The cutters are variously provided with varied geometry chamfers and are positioned along the profile 420 with the chamfers 421, 422, 424, 423, 424, 425, 426, 427, and 428 oriented to provide vector forces 431, 432, 433, 434, 435, 436, 437, and 438 on the cutters, respectively, in directions at angled with respect to the normal to the engaged formation surface along the profile 420. When drilling with the drill bit 410, the varied chamfers (larger inward and smaller outward) the of cutters 411, 412, 413, and 414 along the cone 419 of the drill bit 410 produce greater combined outward directed side force than the combined inward directed side force produced by cutters 415, 416, 417, and 418. A total outward directed side force 440 can therefore be made using the variable chamfer cutters according to one embodiment of the invention. Such an outward directed side force 440 can be useful for designing and making a drill bit that has controlled walking characteristics, as for example for purposes of directional drilling. It will be understood by those skilled in the art based upon this disclosure that the varied chamfer geometry according to other embodiments of the invention may be arranged to provide any number of possible resultant total forces on a drill bit.

Thus, what has been disclosed includes a variable chamfer ultra hard cutter that can be costs effectively formed in combination with the forming one or more depressions or other shaping of the ultra hard working surface of the cutter. For example, a working surface can be formed with one or a plurality of depressions in the intended critical region and extending radially to the cutting edge. With little if any modification, a process of forming a chamfer that would have been a constant size around the edge of a flat top cutter will result in forming a variable size chamfer along the edge at the working surface depression. Rotating a cylindrical cutter about its axis with a fixed angled chamfering tool will cut a chamfer that varies in size circumferentially around the edge of the cutter. The chamfer will be smaller where the depression is deep along the cutting edge and the chamfer will be larger at the edges where the depression is shallow.

The shaped working surface also provides other useful characteristics for ultra hard cutters that cooperate with the useful characteristics of a variable chamfer. For example, one embodiment of a shaped working surface shown in (FIG. 12) provides a section angle of greater than 90 degrees for the cutting edge. It can strengthen the cutting edge and reduce edge chipping and spalling. At the same cutting depth, the shaped working surface has a larger area and a longer portion of cutting edge in contact with the formation than flat top surface. This can reduce the stress from cutting and hence reduce chipping and spalling. The shaped working surface enables a larger angle between the interface and the cutting load direction (FIG. 13 impact loading). The increased angle can reduce shear stress at the interface and hence increase delamination resistance. Combined design of the shaped working surface and the non-planar interface can reduce harmful components of thermal residual stress. The shaped cutting edge features a varying chamfer or radius. The chamfer varies with different cutting depth. Under normal drilling condition, the cutting depth is confined. The average chamfer is small and the cutter has good cutting efficiency. Under severe loading such as impact and excessive WOB, the cutting depth increases, and so does the average chamfer size. Increased chamfer size gives more protection to the cutting edge from chipping or spalling. Also, the increase of chamfer size with excessive cutting depth can prevent the bit from drilling too aggressively, hence drilling stability is increased for the whole bit. According to certain embodiments of the invention, a varied chamfer cutter can have a minimum influence on drilling efficiency, while increasing drilling stability and improving the endurance of the diamond cutter.

According to one embodiment a drill bit is formed using cutters with variable chamfers to obtain a desired "effective" back rake angle provided by the combined effect of the angle of the top working surface of the cutter and the angle and depth of the chamfers at the critical areas at which the cutters engage the formation during drilling. The chamfer of the cutter can be varied according to the position on a drill bit and the predicted shape and depth of cut of the cutter during drilling so that wider chamfer is provided to correspond to deeper expected cut areas.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should include not only the embodiments disclosed but also such combinations of features now known or later discovered, or equivalents within the scope of the concepts disclosed and the full scope of the claims to which applicants are entitled to patent protection.

What is claimed is:

1. A cutter for an earth boring drag bit, said bit comprising a bit body including a portion for connecting with a drill string, the cutter comprising:

a substrate mountable on one of a plurality of blades extending from said bit body; and an ultra hard material layer over said substrate, said ultra hard material layer comprising, a working surface, a side surface adjacent the working surface and generally parallel to a cutter axis, an arcuate cutting edge formed between the working surface and the side surface, said arcuate cutting edge being a peripheral edge of said working surface extending around an entire a periphery of said working surfaces, and a chamfer along the entire arcuate cutting edge between said working surface and said side surface, the chamfer having a varied geometry.

2. The cutter of claim 1, wherein the varied geometry of the chamfer comprises a varied width of the chamfer along the edge.

3. The cutter of claim 1, wherein the varied geometry of the chamfer comprises a varied angle of the chamfer.

4. The cutter of claim 1, wherein the varied geometry of the chamfer comprises a varied width and a varied angle of the chamfer.

5. The cutter of claim 1, wherein the ultra hard material comprises a polycrystalline diamond material.

6. The cutter of claim 1, wherein the ultra hard material comprises a polycrystalline cubic boron nitride material.

7. The cutter of claim 1, wherein the working surface comprises a planar surface intersecting with the chamfer at the edge.

8. The cutter of claim 1, wherein the working surface comprises a dome shaped surface intersecting with the chamfer at the edge.

9. The cutter of claim 1, wherein the working surface comprises a planar surface having at least one depression extending from a portion of the working surface interior to the edge and intersecting with the chamfer at a critical region along the edge.

10. The cutter of claim 9, wherein the at least one depression comprises a plurality of depressions.

11. The cutter of claim 9, wherein the depression comprises a planar surface.

12. The cutter of claim 9, wherein the depression comprises a curved surface.

13. The cutter of claim 9, wherein the varied geometry of the chamfer comprises a varied width of the chamfer further comprising increasing the width of the chamfer along the edge in either direction from a central portion of the critical region.

14. The cutter of claim 9, wherein the varied geometry of the chamfer comprises a varied angle of the chamfer further comprising increasing the angle of the chamfer along the edge in either direction from a central portion of the critical region.

15. The cutter of claim 1, wherein the working surface comprises a curved surface having at least one depression extending from a portion of the working surface interior to the edge and intersecting with the chamfer at a critical region along the edge.

16. The cutter of claim 15, wherein the at least one depression comprises a plurality of depressions.

17. The cutter of claim 15, wherein the curved working surface comprises a dome shaped working surface.

18. The cutter of claim 15, wherein the depression comprises a planar surface.

19. The cutter of claim 15, wherein the depression comprises a curved surface.

20. The cutter of claim 15, wherein the varied geometry of the chamfer comprises a varied width of the chamfer further comprising increasing the width of the chamfer along the edge in either direction from a central portion of the critical region.

21. The cutter of claim 15, wherein the varied geometry of the chamfer comprises a varied angle of the chamfer further comprising increasing the angle of the chamfer along the edge in either direction from a central portion of the critical region.

22. The cutter of claim 1 wherein the chamfer comprises one portion defining a first width and a first angle configuration and another portion defining a second width and a second angle configuration, wherein the first width configuration is different from the second width configuration.

23. The cutter of claim 1 wherein the chamfer comprises one portion defining a first width and a first angle configuration and another portion defining a second width and a second angle configuration, wherein the first angle configuration is different from the second width configuration.

24. The cutter of claim 23 wherein the first width configuration is different from the second width configuration.

25. A cutter for an earth boring drag bit comprising a bit body including portion for connecting with a drill string, the cutter comprising:

a support body mountable on one of a plurality of blades extending from said bit body, said support body having an axial orientation; and an ultra hard material over the support body, the ultra hard material comprising, a working surface secured to the support body at an interface, the working surface having a plurality of depressions oriented at oblique angles relative to the axial orientation of the support body, and a chamfered edge with a varied width chamfer between the plurality of depressions.

26. The cutter of claim 25, wherein at least one of the depressions comprises an obtuse angle relative to the axial orientation of the support body, so that the chamfer is wider between the depressions.

27. The cutter of claim 25, wherein at least one of the depressions comprises an angle between about 91° and about 130° relative to the axial orientation of the support body.

28. A cutter for an earth boring drag bit comprising a portion for connecting with a drill string, the cutter comprising:

a support body having an axial orientation and defining a non-planar interface support surface; and a polycrystalline diamond material bonded to the non-planar interface support surface and defining a working surface spaced apart from the non-planar interface, wherein the working surface comprises an arcuate cutting edge, a chamfer extending from said arcuate cutting edge and at least one depression at an obtuse angle to the axial orientation of the support body extending to said arcuate cutting edge, and wherein the non-planar interface comprises a portion of the support surface generally aligned with the depression and at an obtuse angle relative to the axial orientation, wherein said chamfer has a variable geometry.

29. The cutter of claim 28, wherein at least a portion of the obtuse angled non-planar interface is at an angle greater than the angle of the working surface depression so that the polycrystalline diamond material is thicker at the periphery edge of the working surface depression.

30. The cutter of claim 28, wherein the polycrystalline diamond material has a minimum thickness greater than or equal to about 0.04 inch and a maximum thickness at the periphery edge of the working surface depression of less than or equal to about 0.160 inch.

31. The cutter as recited in claim 28 wherein said support body is mountable on one of a plurality of blades extending from said bit body.

32. An earth boring drag bit comprising:

a drag bit body comprising a portion for connecting with a drill string;

a plurality of blades extending from said bit body; and at least one cutter held by at least one of said blades, the at least one cutter having an ultra hard working surface, the working surface including an arcuate cutting edge, said arcuate cutting edge being a peripheral edge of said working surface extending around an entire periphery of said working surface, and a chamfer with a varied geometry along the cutting edge, the chamfer extending around the entire periphery of the working surface.

33. The drag bit of claim 32 wherein the chamfer is varied to modify the effective back rake angle along a selected critical area of the cutter face.

34. The drag bit of claim 32 wherein the chamfer is varied base upon the intended position of the cutter on the drill bit, and to relatively increase the size of the chamfer in one critical area of the cutter face predicted to have a relatively large depth of cut at the interface with the formation and the chamfer is varied to relatively reduce the size of the chamfer in another critical area of the cutter face predicted to have a relatively small depth of cut.

35. An earth boring drag bit comprising:

a drag bit body;

a plurality of blades formed on the bit body; and a plurality of cutters held by at least one of the blades, at least one of the plurality of cutters having an ultra hard material having a shaped working surface with an arcuate cutting edge, said arcuate cutting edge being a peripheral edge of said working surface extending around an entire periphery of said working surface, a side surface adjacent the cutting edge disposed generally parallel to a cutter axis, and a varied geometry chamfer along said entire periphery between the working surface and the side surface.

36. The drill bit of claim 35 wherein the varied geometry comprises a varied geometry increasing the effective back rake angle in areas expected to have a relatively deep cut according to a placement of the cutter on the drill bit and to decrease the effective back rake angle in areas expected to have a relatively shallow depth of cut.

37. The drill bit of claim 35 wherein the varied geometry comprises a geometry of the chamfer varied on at least one of the plurality of cutters to increase the effective back rake angle in areas of cutters expected to have a relatively deep cut according to a placement of the cutter on the drill bit and to decrease the effective back rake angle in areas of cutters expected to have a relatively shallow depth of cut.

38. The drill bit of claim 35 wherein the varied geometry comprises a geometry of the chamfer varied on at least one of the plurality of cutters to control the total side forces on the drill bit so that the drill bit has pre-selected directional drilling characteristics.

39. The drill bit of claim 38 wherein the varied geometry comprises a geometry of the chamfer varied on a plurality of the cutters to control the total side forces on the drill bit so that the drill bit has a total side force consistent with pre-selected directional drilling characteristics.

40. A polycrystalline diamond compact for an earth boring drag bit comprising a body including portion for connecting with a drill string, the compact comprising:

a substrate mountable on one of a plurality of blades extending from said bit body;

a polycrystalline diamond working surface over said substrate, said working surface having an arcuate cutting edge;

a side surface adjacent the arcuate cutting edge and generally parallel to a cutter axis; and a chamfer along the arcuate cutting edge between the working surface and the side surface, the chamfer having a first chamfer portion defining a first width and first angle configuration and a second chamfer portion defining a second width and second angle configuration, wherein at least one of the width and angle configuration of the first chamfer portion and the second chamfer portion are different.

41. The compact of claim 40, wherein the widths of the first chamfer portion and the second chamfer portion are different.

42. A cutter for an earth boring drag bit comprising a body including a portion for connecting with a drill string, the cutter comprising:

a substrate mountable on one of a plurality of blades extending from said bit body; and an ultra hard material layer bonded to said substrate, the ultra hard material layer comprising, a working surface with an arcuate cutting edge, and a chamfer along the arcuate cutting edge, the chamfer having a varied geometry and extending around the entire periphery of the working surface.

43. A cutter for an earth boring drag bit comprising a body including a portion for connecting with a drill string, the cutter comprising:

a substrate mountable on one of a plurality of blades extending from said bit body; and an ultra hard material layer bonded to said substrate, the ultra hard material layer comprising, a working surface with an arcuate cutting edge, and a chamfer along the cutting edge, the chamfer having a varied geometry;

wherein the varied geometry of the chamfer comprises at least one selected from a varied angle of the chamfer and a varied width of the chamfer, and the varied geometry of the chamfer increases in magnitude in a direction away from a point of maximum contact in a critical region.

44. An earth boring drag bit comprising:

a drag bit body;

a plurality of blades formed on the bit body; and a plurality of cutters held by at least one of said blades, at least one of the plurality of cutters having an ultra hard working surface with an arcuate cutting edge, said arcuate cutting edge being a peripheral edge of said working surface extending around at least a portion of a periphery of said working surface, and a varied geometry chamfer along at least a portion of the cutting edge, wherein the varied geometry of the chamfer comprises at least one selected from a varied angle of the chamfer and a varied width of the chamfer, and wherein the varied geometry of the chamfer increases in magnitude in a direction away from a point of maximum contact in a critical region.

45. The cutter of claim 44 wherein said peripheral edge extends along an entire periphery of said working surface.

* * * * *

UNITED STATES PATENT AND TRADEMARK OFFICE

CERTIFICATE OF CORRECTION

PATENT NO. : 7,726,420 B2
APPLICATION NO. : 11/117648
DATED : June 1, 2010
INVENTOR(S) : Yuelin Shen et al.

It is certified that error appears in the above-identified patent and that said Letters Patent is hereby corrected as shown below:

In the Figures

| | |
|---|---|
| FIG. 9, Sheet 6 of 17 | Delete Drawing Sheet 6 and substitute therefore the Drawing Sheet, consisting of FIG. 9, as shown on the attached page. |
| Column 17, Claim 1, line 60 | Delete "a" |
| Column 17, Claim 1, line 61 | Delete "surfaces" Insert -- surface -- |
| Column 20, Claim 34, line 5 | Delete "base" Insert -- based -- |

Signed and Sealed this
Eighth Day of March, 2011

David J. Kappos

David J. Kappos
*Director of the United States Patent and Trademark Office*